US007086727B2

(12) United States Patent
Nishikawa et al.

(10) Patent No.: US 7,086,727 B2
(45) Date of Patent: Aug. 8, 2006

(54) HEAT FIXING APPARATUS FOR SUBLIMATING AND FIXING SUBLIMATING INK TO RECORDING MEDIUM

(75) Inventors: Hidetoshi Nishikawa, Wakayama (JP); Kazunobu Shima, Wakayama (JP); Masazumi Ishikawa, Wakayama (JP); Kazuo Nagaosa, Wakayama (JP); Masaki Nakamoto, Wakayama (JP); Masanori Inoshita, Wakayama (JP); Masasuke Funase, Wakayama (JP); Toshihiro Matsuoka, Wakayama (JP)

(73) Assignee: Noritsu Koki Co., Ltd., Wakayama-Ken (JP)

( * ) Notice: Subject to any disclaimer, the term of this patent is extended or adjusted under 35 U.S.C. 154(b) by 0 days.

(21) Appl. No.: 10/365,217

(22) Filed: Feb. 12, 2003

(65) Prior Publication Data

US 2003/0156177 A1 Aug. 21, 2003

(30) Foreign Application Priority Data

| | | |
|---|---|---|
| Feb. 14, 2002 | (JP) | 2002-036982 |
| Apr. 11, 2002 | (JP) | 2002-109469 |
| May 14, 2002 | (JP) | 2002-138745 |
| May 14, 2002 | (JP) | 2002-138746 |
| Dec. 4, 2002 | (JP) | 2002-352596 |

(51) Int. Cl.
*B41J 2/01* (2006.01)

(52) U.S. Cl. ..... 347/102; 347/108

(58) Field of Classification Search ..... 347/102, 347/105, 101, 108
See application file for complete search history.

(56) References Cited

U.S. PATENT DOCUMENTS

| | | | | |
|---|---|---|---|---|
| 5,020,244 | A * | 6/1991 | Smith | 34/633 |
| 5,296,873 | A * | 3/1994 | Russell et al. | 346/25 |
| 5,502,464 | A * | 3/1996 | Takahashi et al. | 346/25 |
| 5,608,439 | A * | 3/1997 | Arbeiter et al. | 347/102 |
| 5,633,668 | A * | 5/1997 | Schwiebert et al. | 347/102 |
| 5,754,208 | A * | 5/1998 | Szlucha | 347/102 |
| 6,120,199 | A | 9/2000 | Takekoshi | |
| 6,210,049 | B1 * | 4/2001 | Yamada et al. | 396/575 |
| 6,285,386 | B1 * | 9/2001 | Suzuki | 347/155 |
| 6,439,712 | B1 * | 8/2002 | Mizutani et al. | 347/102 |
| 6,463,674 | B1 * | 10/2002 | Meyers et al. | 34/304 |
| 6,523,949 | B1 * | 2/2003 | Ewert | 347/105 |
| 6,530,657 | B1 * | 3/2003 | Polierer | 347/102 |
| 6,536,863 | B1 * | 3/2003 | Beauchamp et al. | 347/17 |
| 6,633,319 | B1 * | 10/2003 | Yamakawa et al. | 347/172 |
| 6,716,562 | B1 * | 4/2004 | Uehara et al. | 430/124 |

FOREIGN PATENT DOCUMENTS

| | | |
|---|---|---|
| DE | 40 21 227 | 6/1991 |

(Continued)

*Primary Examiner*—Manish Shah
*Assistant Examiner*—Leonard Liang
(74) *Attorney, Agent, or Firm*—Fulbright & Jaworski L.L.P.

(57) ABSTRACT

A heat fixing apparatus has a heating unit for heating a recording medium having a substrate, a fixing layer and a surface layer so as to sublimate sublimating ink applied in advance to the surface layer for transferring the sublimated ink to the fixing layer. The heating unit includes a heating transporting mechanism for transporting the recording medium within a heating space, a heater body for heating air, and a blower mechanism for supplying hot air heated by the heater body to the recording medium being transported by the heating transporting mechanism. The apparatus further includes a flat guide member for coming into contact with the surface of the recording medium being transported by the heating transporting mechanism and a heater for heating the guide member.

6 Claims, 19 Drawing Sheets

FOREIGN PATENT DOCUMENTS

| | | | | |
|---|---|---|---|---|
| EP | 0 538 071 | | | 4/1993 |
| EP | 0 568 172 | A1 | | 11/1993 |
| JP | 5808 1168 | | | 5/1983 |
| JP | 58081168 | | | 5/1983 |
| JP | 61-197444 | | | 1/1986 |
| JP | 63306048 | A | * | 12/1988 |
| JP | 40214469 | | | 1/1992 |
| JP | 08-002063 | | | 1/1996 |
| JP | 08011299 | | | 1/1996 |
| JP | 08-311782 | | | 11/1996 |
| JP | 10-016188 | | | 1/1998 |
| JP | 10-230589 | | | 9/1998 |
| JP | 10-297197 | | | 11/1998 |
| JP | 2000203001 | A | * | 7/2000 |
| JP | 2000-315026 | | | 11/2000 |
| JP | 2001-105638 | | | 4/2001 |
| JP | 2001-212955 | | | 8/2001 |

* cited by examiner

HEAT FIXING APPARATUS FOR SUBLIMATING AND FIXING SUBLIMATING INK TO RECORDING MEDIUM

BACKGROUND OF THE INVENTION

1. Field of the Invention

The present invention relates to a heat fixing apparatus including a heating unit for heating a recording medium having a substrate, a fixing layer and a surface layer so as to sublimate sublimating ink applied in advance to the surface layer for transferring the sublimated ink to the fixing layer.

2. Description of the Related Art

An exemplary conventional technique relating to the above field of art is disclosed in Japanese patent application "Kokai" No: Hei. 10-297197. According to this, a metal substrate includes a coloring ground layer (corresponding to a "fixing layer" in the present invention) acting also as a rust-preventive layer, a transparent resin layer as an optical transparent resin layer formed over the coloring ground layer, the resin layer being made of acrylic resin, polyester resin, urethane resin etc., and an inkjet receiving layer (corresponding to a "surface layer" in the present invention) formed over the resin layer and made of e.g. porous alumina to form an ornamental metal body. After application of a sublimating ink or pigment on the inkjet receiving layer by an inkjet printing to form a colored pattern, the sublimating pigment is heated in a heating furnace or by a hot press, whereby the sublimating pigment in the inkjet receiving layer is sublimed into the transparent resin layer. As a result, the colored pattern formed in the ink receiving layer is formed in the transparent layer. Then, the inkjet receiving layer is removed to obtain an ornamental metal body having a colored pattern fixedly formed within the transparent resin layer.

According to an art presently under development, a recoding layer comprises a flexible resin sheet as the substrate, a fixing layer formed on the surface of this substrate and a surface layer (providing a similar function to the inkjet receiving layer described above) formed on the surface of the fixing layer, so that image information printed on the surface layer is subsequently heated to be transferred to and fixed in the fixing layer. Further, no apparatus has yet been developed which is capable of carrying out a continuous process for printing record information of the surface layer of such recording medium with sublimating ink and then heating the medium to sublimate the sublimating ink for transferring it onto the fixing layer.

Still further, Japanese patent application "Kokai" No: Hei. 10-16188 discloses an image forming apparatus. According to this, first, a primary image is formed on a thermal transfer sheet by e.g. an inkjet printer. Then, this thermal transfer sheet having the image formed thereon is laid over a recording sheet and these sheets are pressed and heated together, whereby the image (ink) formed on the thermal transfer sheet will be sublimed by the heat and transferred onto an ink fixing layer of the recording sheet, thus forming a secondary image thereon.

According to further art disclosed by Japanese patent application "Kokai" No: 2001-105638, sublimating ink is transferred from an ink ribbon onto a surface of a recording sheet. In order to heat and fix the ink on the sheet, the sheet is charged into a heater box, in which the sheet is advanced and heated between a press roll and a heat roll opposed to each other with a small gap therebetween or between a heat roll and a conveyer belt disposed along a portion of the peripheral face of the heat roll.

Further, in the field of textile printing, according to an exemplary technique disclosed by Japanese patent application "Kokai" No: Hei. 08-311782, dye is applied to a textile by the inkjet printing method. Then, in order to reinforce the fixing of the dye and also to improve its color development, the textile is charged into a heater device to be heated therein. Then, the textile is discharged from the device immediately to be cooled at the normal temperature.

With such apparatuses for effecting transfer in the recording medium by means of heating, the following inconveniences are expected to occur. For instance, in the case of using a flexible resin sheet as the substrate of the recording medium, when the heating takes place with irregularity in the apparatus with uneven force application, this will result in deformation in the substrate, so that the substrate will loose its flatness. Especially, when heating is effected in an irregular manner, the ink transfer will develop at an area having a high temperature whereas the ink transfer will be retarded or restricted in an area having a low temperature. This will lead to density and/or color irregularity of the transferred record information.

More particularly, a recording medium using fluororesin as the fixing layer is suitable for producing a product having superior weather resistance to products having image formed (printed) with silver-salt print paper or with an inkjet printer. Therefore, such product may be used as a billboard to be installed outdoors or a sticker or seal or the like for outdoor use. In using this type of recording medium outdoors, it will be effective to employ, as the substrate thereof, a PET (polyethylene terephthalate) resin sheet which is relatively inexpensive and has good water resistance as well as good flatness. This PET resin is thermoplastic. Hence, during heating of the recording medium, if the medium is heated while being pinched between and transported by heating press roller pair, unevenness if any in the pressing force from the press rollers or irregularity in the temperature distribution in the surfaces of the rollers will impair the flatness of the substrate, when in turn leads to density or color irregularity in the transferred image or the like. For this reason, there is a need for art allowing uniform heating.

SUMMARY OF THE INVENTION

In view of the art, a primary object of the present invention is to provide a heating fixing apparatus capable of effecting heating fixing in an optimal manner with uniform heating.

For accomplishing the above-noted object, according to the present invention, a heat fixing apparatus comprises a heating unit for heating a recording medium having a substrate, a fixing layer and a surface layer so as to sublimate sublimating ink applied in advance to the surface layer for transferring the sublimated ink to the fixing layer, wherein the heating unit includes a heating transporting mechanism for transporting the recording medium within a heating space, a heater body for heating air, and a blower mechanism for supplying hot air heated by the heater body to the recording medium being transported by the heating transporting mechanism.

With the above-described feature, according to the invention's heating fixing apparatus relating to claim 1 while the recording medium is being transported within the heating space by the heating transporting mechanism, the blower mechanism supplies the hot air heated by the heater body to this recording medium, thus realizing the heating of the medium. Further, since this heated air flows in contact with the surface of the recording medium, local heating may be avoided for enabling uniform heating. That is to say, as the air having fluidity is caused to come into contact with a large area of the recording medium, the uniform heating is made possible. As a result, transfer may take place in a favorable manner through the uniform heating provided by the combination of the heater body and the blower mechanism. Moreover, this, transfer may take place without inviting deformation in the recording medium even if this medium employs thermoplastic resin as the substrate thereof.

Preferably, the blower mechanism is adjustable in its blowing direction so as to supply the hot air from transportation-wise downstream to transportation-wise upstream of the recording medium.

With this feature, it becomes possible to allow the hot air immediately after heating thereof and having highest temperature to contact the downstream area of the medium where the heating transfer has fairly progressed and also to allow the hot air having somewhat lowered temperature to contact the upstream area of the medium where the heating transfer is about to begin. Namely, disadvantage due to rapid increase in the temperature of the recording medium just introduced into the heating fixing space is avoided and then, the warming is carried out mildly to allow sufficient heating of the medium at the terminal end of the transport line. Consequently, the transfer may be carried out without inviting color or density irregularity due to rapid temperature rise or deformation in the type of recording medium using thermoplastic resin in its substrate.

Preferably, the apparatus further comprises a flat guide member for coming into contact with the surface of the recording medium being transported by the heating transporting mechanism and a heater for heating the guide member.

With this feature, the recording medium can be heated not only with the heat in the hot air supplied by the blower mechanism, but also with additional heat supplied from the guide member contacting the recording medium. That is, by allowing the medium to contact the flat guide member, the heating may proceed in a reliable manner with utilizing the direct heat conduction therefrom. As a result, even a thick recording medium can be heated to the transferring or fixing temperature without inviting deformation in the medium, whereby the transfer may be effected reliably.

According to one preferred embodiment of the invention, the heating transporting mechanism is adapted for transporting the recording medium in the horizontal direction and a plurality of said guide members are provided along the transporting direction of the heating transporting mechanism downwardly of the transport passage of this heating transporting mechanism, some of the guide members disposed transportation-wise downstream having a temperature set higher than a temperature of others of the guide members disposed transportation-wise upstream.

With this construction, it becomes possible to transport the recording medium with keeping its horizontal posture while the medium is placed in contact with the upper faces of the plurality of guide members. Since the temperature of the heat to be transmitted to the recording medium may be gradually raised with advance of this transportation, sharp rising in the temperature may be avoided. That is, the recording medium can be heated under the stable posture on the upper faces of the guide members with the heat from the guide members and the heat of the hot air from the blower mechanism. Consequently, it is possible to realize more reliable transfer with the uniform heating without inviting deformation.

Preferably, the apparatus further comprises a preliminary heating section disposed on the transport passage for feeding the recording medium to the heating space and adapted for providing the recording medium with heat of a temperature lower than the heating temperature of the heating space.

With this construction, as the recording medium is heated to a certain lower temperature at the preliminary heating section and then heated to the higher temperature at the heating space, the time needed for the temperature of the recording medium to be raised to the transferring temperature may be reduced. As a result, reliable transfer is possible without inviting shortage of heating.

Further preferably, the apparatus further comprises a slow cooling section for discharging heat from the recording medium discharged from the heating space while providing the medium with a temperature lower than the heating temperature of the heating space.

With this, heat may be discharged from the recording medium exiting the heating space under mildly heated condition thereof. With implementation of such heat discharging mode, the recording medium which has been heated at the heating space is not cooled rapidly and also local heat discharge therefrom too can be avoided. As a result, flat and smooth surface condition may be realized on the recording medium by avoiding deformation due to non-uniform heat discharge therefrom.

Preferably, the slow cooling section includes a guide member inclined for guiding the recording medium obliquely downward while contacting the lower face of this recording medium discharged in the horizontal direction from the heating space and an electric heater for heating this guide member, the electric heater heating the guide member at a temperature which is gradually lowered on the downstream side in the transporting direction of the recording medium.

With this feature, at the slow cooling section, heat may be discharged from the recording medium while this medium is being guided obliquely downwards with its lower face contacting the inclined guide member. And, in the course of this guiding by the guide member, rapid heat discharge may be restricted by the temperature from the guide member. Also, this temperature of the guide member is gradually lowered on the downstream side in the transporting direction, very mild heat discharge process is realized. As a result, flat and smooth surface condition may be realized on the recording medium by avoiding deformation due to non-uniform heat discharge therefrom.

Preferably, the heating transporting mechanism is adapted for transporting the recording medium at a set speed, and a heating-area adjusting mechanism is provided for adjusting a width of the heating area of the heating fixing space according to the width of the recording medium.

With this, the heating transfer process may be effected on the recording medium which is being transported at a set speed, with appropriate adjustment of the width of the heating area of the heating space according to the width of the recording medium. That is to say, by adapting the width of the heating space to the width of the recording medium, heating of space where no heating is needed may be avoided and the recording medium is transported at the set fixed speed, thereby to realize reliable transfer. Consequently, waste of energy required for heating may be eliminated.

Further and other features and advantages of the invention will become apparent upon reading of the following detailed description of preferred embodiments thereof with reference to the accompanying drawings.

DESCRIPTION OF THE PREFERRED EMBODIMENTS

Preferred embodiments of the invention will be described in details with reference to the accompanying drawings.

Figure 1:
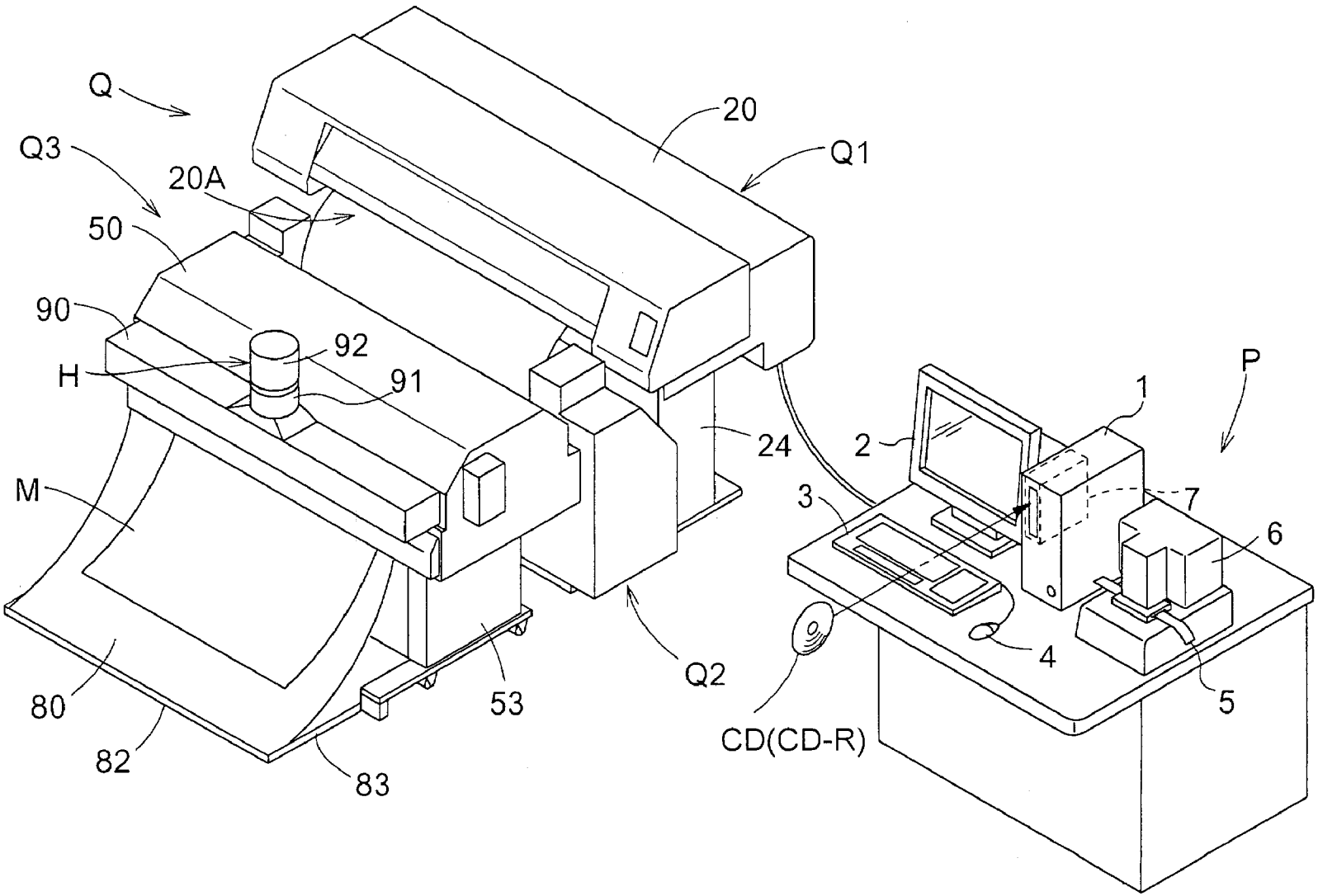
FIG. 1 is a perspective view showing an image forming apparatus.

As shown in FIG. 1, an image forming system Q is provided for printing image information transmitted from an image processing apparatus P on a recording medium M with a sublimating type ink, cutting the medium into a print size, heating the medium for fixing the ink thereto and discharging the medium.

The image processing apparatus P includes a general-purpose computer 1, a monitor 2, a keyboard 3, a mouse 4 as well as a film scanner 6 for effecting photoelectric conversion of image information of a developed silver-salt photographic film 5 and a media drive 7 incorporated within the computer for obtaining information stored in the medium in the form of digital signals. Here, the media drive 7 collectively refers to drive devices for obtaining information from disc type media such as CD, CD-R or MO, as well as semiconductor media such as Compact-Flash, Smart-Media, etc. FIG. 1 shows an exemplary media drive for reading information from CD and CD-R.

Figure 4:
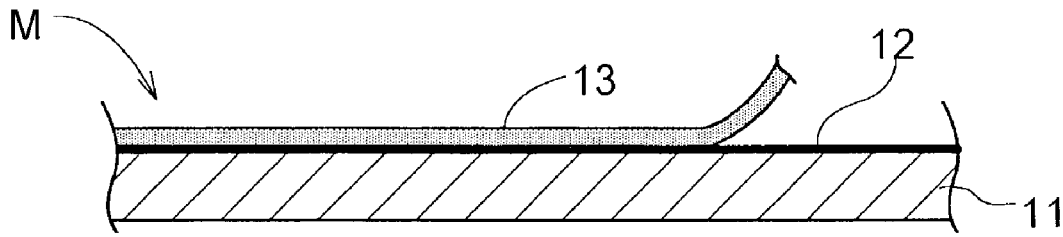
FIG. 4 is a side view in vertical section of a recording medium.

The recording medium M, as shown in FIG. 4, is a flexible sheet assembly including a film-like substrate 11 made of PET (polyethylene terephthalate), a fixing layer 12 laid over the surface of the substrate 11 and made of resin having affinity for the sublimating ink, such as polyvinyl alcohol resin, polyvinyl acetal resin, or the like, and a thin-film like surface layer 13 detachably attached on the surface of the fixing layer 12, the surface layer 13 being Conned of material having no affinity for the sublimating ink, such as fluororesin, silicone resin, etc. In operation, after an image is printed with the sublimating ink on the surface layer 13 of the recording medium M, this medium is subjected to a heating process, in which the ink applied on the surface layer 13 will sublime to be transferred and fixed to the fixing layer 12, thus fixing the image information on the surface of the substrate 11. After completion of the transfer fixing of the image information, the surface layer 13 will be removed thereby to expose the clear-defined image formed in the fixing layer 12 of the surface of the substrate 11. If the material forming the substrate 11 of the recording medium M has affinity for the sublimating ink, then, the surface of this substrate 11 may be used directly as a fixing layer 12.

Figure 2:
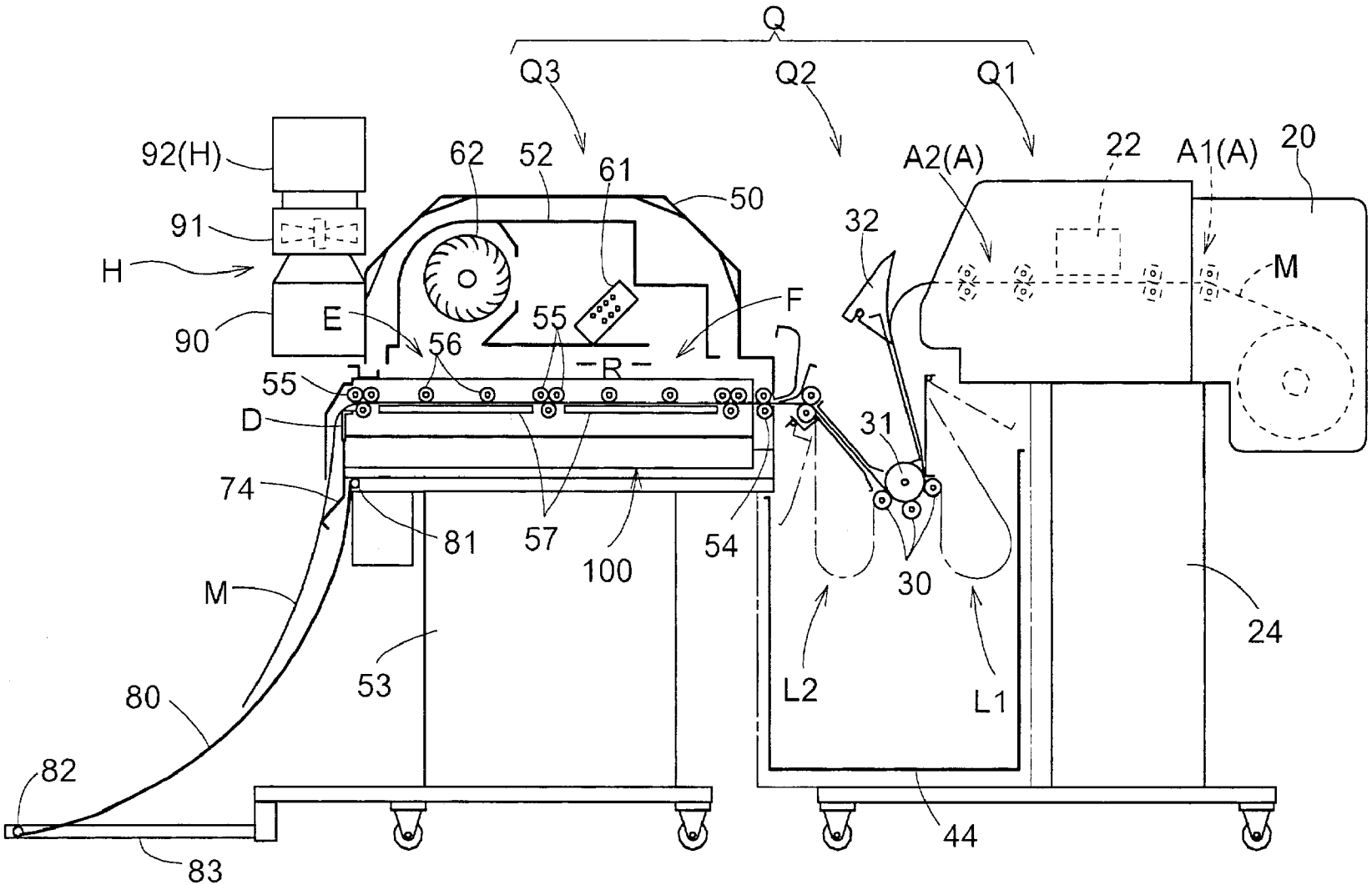
FIG. 2 is a partially cutaway side view showing the image forming apparatus.
Figure 3:
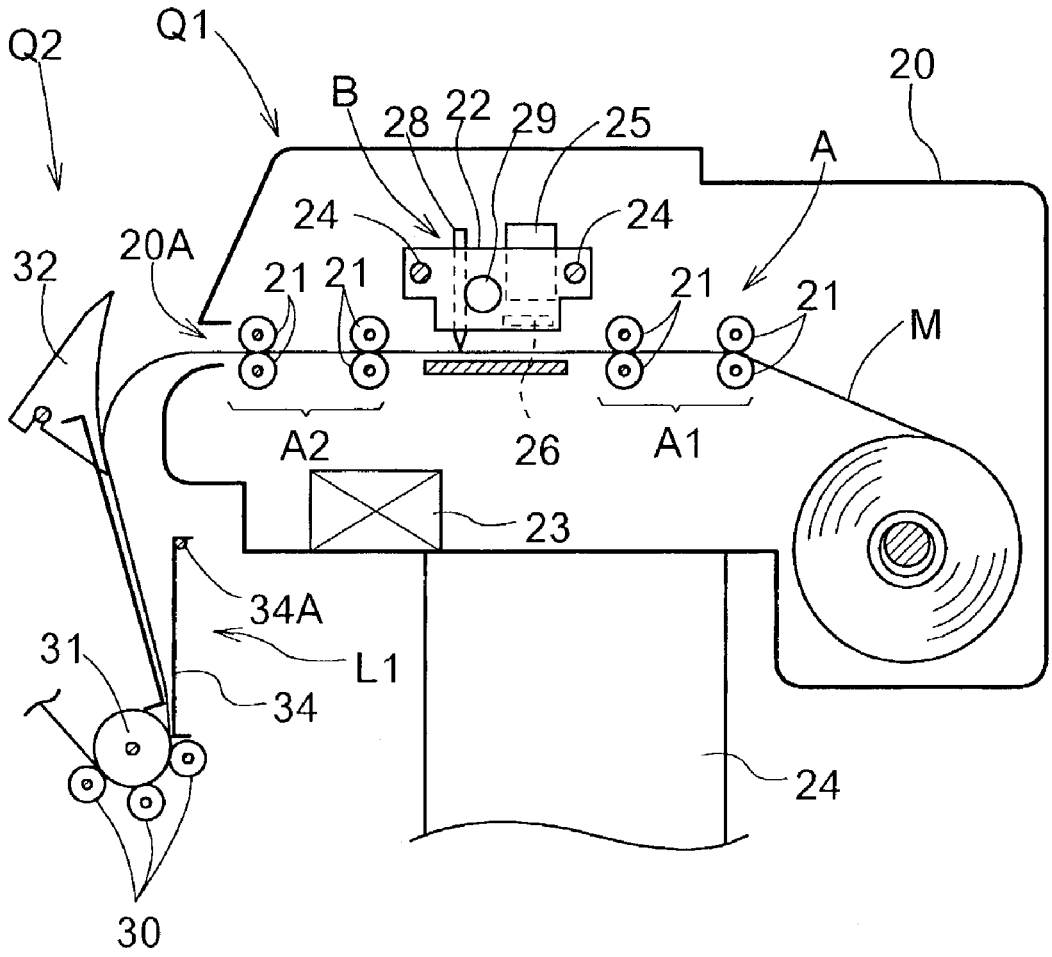
FIG. 3 is a side view in vertical section of a printing unit.

As shown in FIGS. 1–3, the image forming apparatus Q includes a printing unit Q1 for printing image information on the recording medium M, a loop-forming unit Q2 for temporarily storing the recording medium 1 which was printed with the image information with the sublimating ink at the printing unit Q1, and a heat fixing unit Q3 (an example of heat fixing apparatus) for receiving the recording medium M from the loop-forming unit Q2. With this image forming system Q, the transporting speed of the recording medium M at the heat fixing unit Q3 is lower than the transporting speed of the medium M at the printing unit. Then, in order to absorb this speed difference, the loop-forming unit Q2 is disposed between the printing unit Q1 and the heat fixing unit Q3. And, the printing unit Q1, the loop-forming unit Q2 and the heat fixing unit Q3 are provided as units detachable from each other. Incidentally, the transporting speed of the recording medium M at the heat fixing unit Q3 is about 300 mm/min. Whereas, the transporting speed of the recording medium M at the printing unit Q1 will actually be determined based on printing resolution of the image information and the width of the recording medium M. Yet, this transporting speed, even at its lowest lever, is still higher than the transporting speed of the medium M at the heat fixing unit Q3.

[Printing Unit]

The printing unit Q1 includes a transporting mechanism A having a plurality of pairs of press type transport rollers 21 for feeding the recording medium M in the form of a roll into a main case 20, an inkjet type print head 22 for printing image information on the recording medium M being transported along a horizontal direction by the transporting mechanism A, a cutter mechanism B provided integrally with the print head 22, and a print controller 23 for controlling these components. As the main body 20 is supported by a support leg 24, the recording medium M printed with image information is fed at a relatively high position in the horizontal direction.

The transporting mechanism A comprises an assembly of a pre-transporting mechanism A1 for transporting the recording medium M roll to the position of the print head 22 and a post-transporting mechanism A2 for transporting the recording medium M from this position of the print head 22 to an outlet 20A. These mechanisms, i.e. the pre-transporting mechanism A1 and the post-transporting mechanism A2, are respectfully driven independently of each other by means of a stepping type transporting motor (not shown). The print head 22 is guided by a pair of guide rods 24 disposed with a posture normal to the transporting direction (sub transporting direction) of the recording medium M and is movable back and forth along a main scanning direction by driven being from a stepping type main scanning motor (now shown). The print head is operable to discharge sublimating ink of an ink cartridge 25 replaceable attached to this print head 22 through a discharge mechanism 26 constituting from e.g. piezoelectric elements so as to print image information.

The cutter mechanism B includes a blade body 28 which is switchable between a position where the body projects toward the recording medium M relative to the print head 22 and a further position where the body is retracted away from the recording medium M, and a switchover motor 29 for switching over the position of this blade body 28 via a cam-feed or screw-feed mechanism (not shown).

Incidentally, the ink cartridge 25 contains inks of 6 colors including the four colors of cyan (C), magenta (M), yellow (Y)and black (K) and also two intermediate colors. With the sublimating type inks employed in this embodiment, the sublimation starts at about 80° C. And, relative to the recording medium M having the film-like PET substrate 11 described above, the optimal ink transfer or fixing condition is realized with heating at 180° C. for about 2 minutes. With these sublimating inks, sublimation will take place smoothly at the temperature range of 170 to 200° C. approximately. And, the transfer fixing becomes possible with heating for about 1 minute at 200° C. or for about 5 minutes at 170° C.

With the above construction, in operation for printing image information on the recording medium M at the printing unit Q1, the print controller 23 activates the transporting mechanism A for transporting the medium M to the position of the print head 22 and then controls the print head 22 for discharging the sublimating ink onto the surface layer 13 of the recording medium M thereby to print the image information thereon. In printing image information in the manner above, while the transport of the recording medium M is suspended, the print head 22 is moved along the scanning direction to discharge the sublimating ink onto the recording medium M. When the print head 22 has reached its stroke end with this scanning, the pre-transporting mechanism A1 and the post-transporting mechanism A2 are driven at a same speed in synchronism with each other for transporting the recording medium M by an amount corresponding to the print width. These series of operations are carried out in repetition. Next, when a particular portion in the recording medium M printed with the image information to be cut, e.g. a position between two adjacent images, reaches the cutting position of the cutter mechanism B, the blade body 28 is switched over to the projecting position and then under this condition, the print head 22 is moved, thereby to cut the recording medium M at this portion. Thereafter, the post-transporting mechanism A2 is activated for discharging the cut recording medium M piece through the outlet 20A.

[Loop-Forming Unit]

Figure 5:
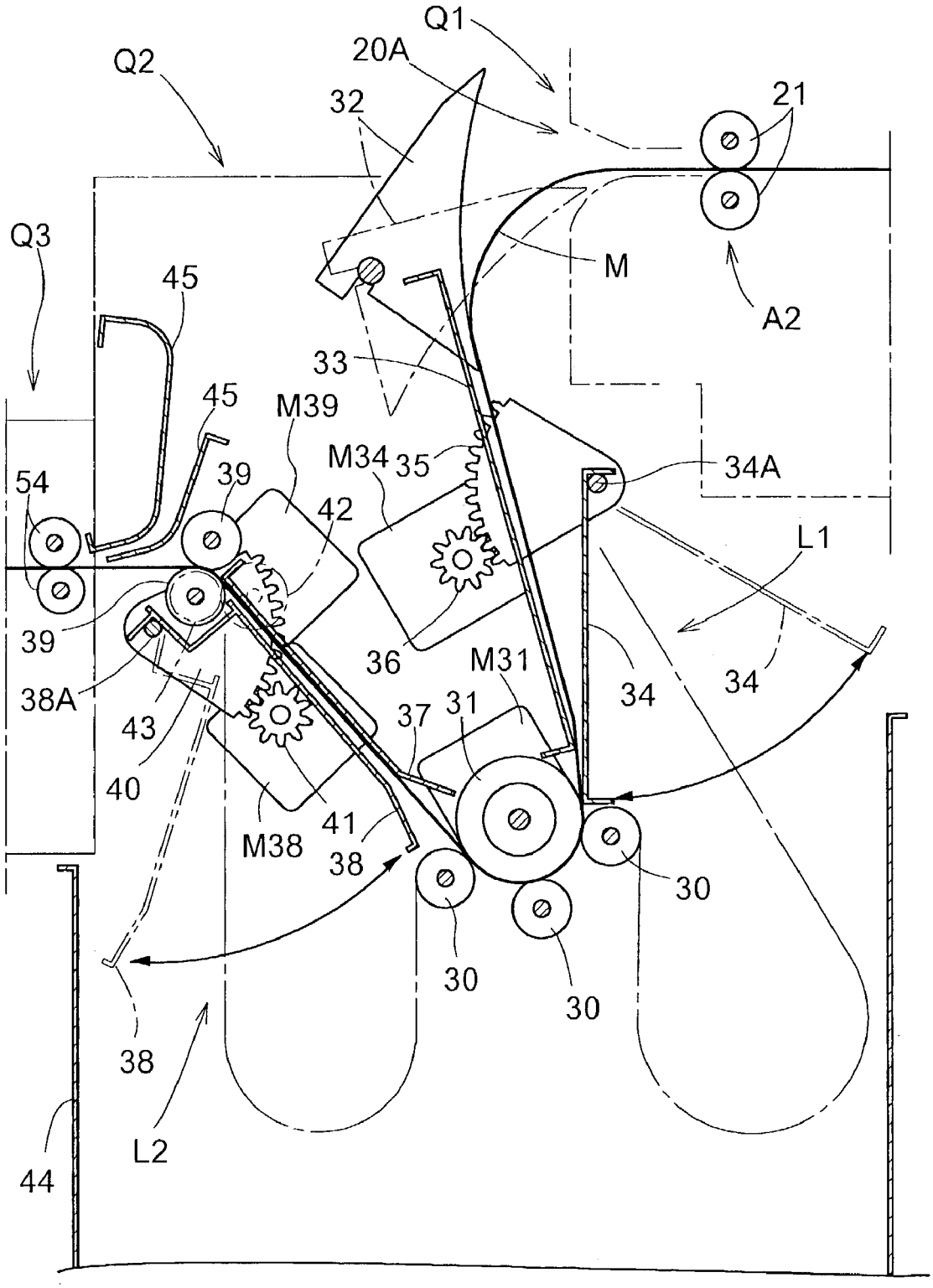
FIG. 5 is a side view in vertical section of a loop-forming unit.
Figure 6:
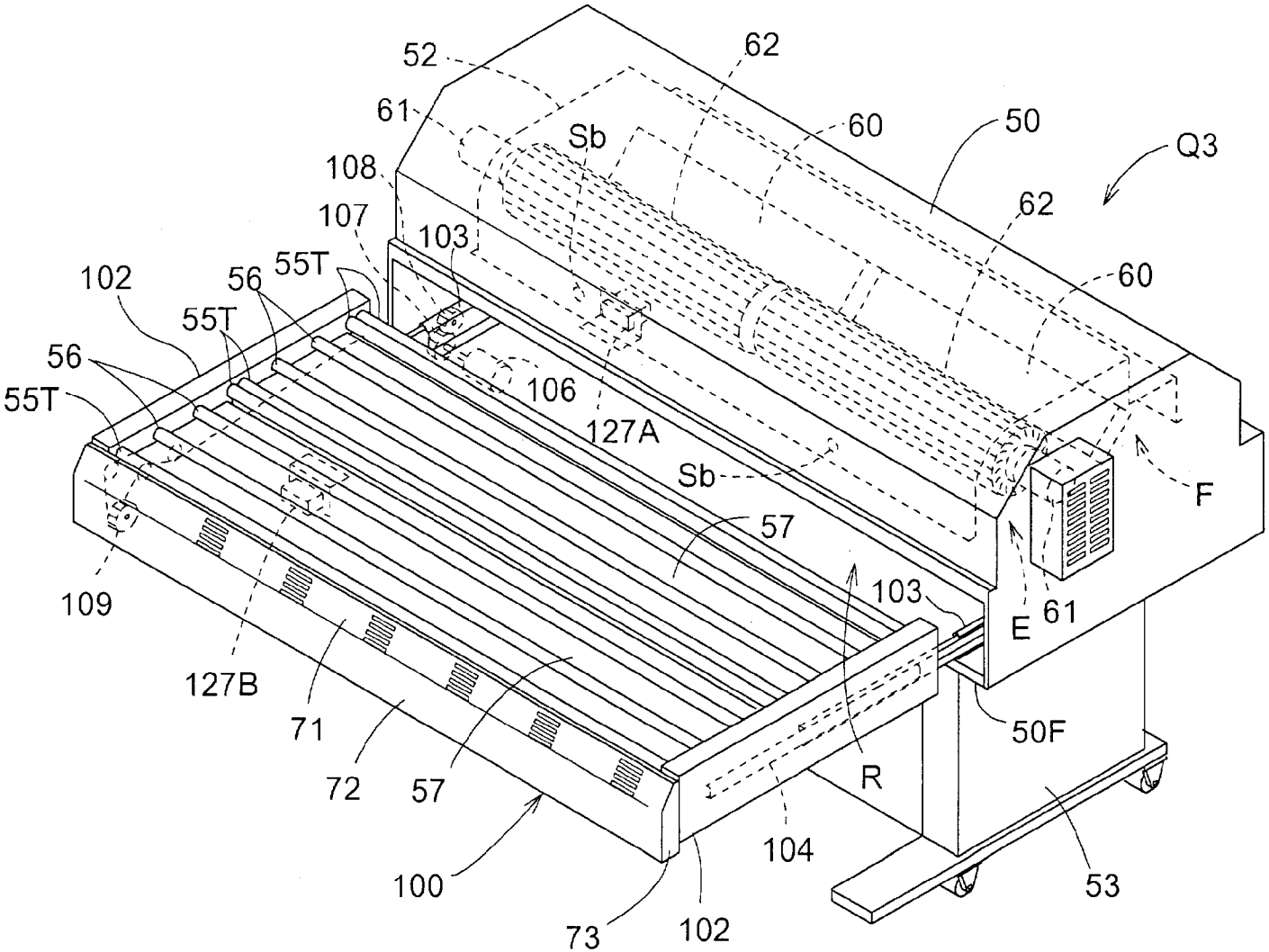
FIG. 6 is a perspective view of a heating fixing unit.

As shown in FIG. 5, the loop-forming unit Q2 includes a turn roller 31 having three driven rollers 30 at the center thereof. The unit Q2 further includes a first loop-forming mechanism L1 disposed transportation-wise upstream of the turn roller 31, a second loop-forming mechanism L2 disposed transportation-wise downstream of the turn roller 31, and a case 44 disposed below these components for receiving the recording medium M.

The turn roller 31 is drivable by a stepping type roller motor M31. In operation, by placing the three driven rollers 30 into pressed contact against the outer periphery of the turn roller 31, the recording medium M will be wound about the turn roller 31 at a relatively large angle, thereby to provide additional function of eliminating curling tendency present in the recording medium M.

The first loop-forming mechanism L1 includes an introduction guide 32 for downwardly guiding the recording medium M discharged from the outlet 20A of the printing unit Q1, a first stationary guide 33 for further downwardly guiding the recording medium M guided downwardly by the introduction guide 32, and a first movable guide 34 disposed in opposition to the first stationary guide 33. An upper end of the first movable guide 34 is pivotally supported to a pivot shaft 34A and a first sector gear 35 mounted on this pivot shaft 34A is meshed with an output gear 36 of a first motor M34, so that with driven from the first motor M34, the first movable guide 34 can be switched over between a closed posture denoted with solid lines in FIG. 5 and a opened position denoted with virtual lines in the same.

The second loop-forming mechanism L2 includes a second stationary guide 37 for guiding the recording medium M transported from the first loop-forming mechanism L1 via the turn roller 31 to the heat fixing unit Q3, a second movable guide 38 disposed in opposition to the second stationary guide 37, and a press type feed roller 39 for feeding the recording medium M to the heat fixing unit Q3. And, an upper end of the second movable guide 38 is pivotally attached to a pivot shaft 38A and a sector gear 40 mounted on this pivot shaft 38A is meshed with an output gear 41 of a second motor M38. Further, an output gear 42 of a feed motor M39 for driving the feed roller 39 is meshed with an input gear 43 mounted on an axial end of the feed roller 39. In operation, with drive from the second motor M38, the second movable guide 38 can be switched over between a closed posture denoted with solid lines in FIG. 5 and an opened posture denoted with virtual lines in the same. And, with drive from the feed motor M39, the feed roller 39 is driven to rotate for feeding the recording medium M from this loop-forming unit Q2 to the heat fixing unit Q3.

In this loop-forming unit Q2, at respective positions along the transport passage for the recording medium M, sensors are provided for detecting presence/absence of the recording medium M at the respective positions. Further, a controller (not shown) is provided for effecting a control scheme to be described next. Namely, when the recording medium M is discharged from the outlet 20A of the printing unit Q1, the first movable guide 34 is set to the closed posture denoted with the solid lines and at the same time the turn roller 31 is driven to rotate at a low speed, thereby to guide the leading end of this recording medium M from the introduction guide 32 to the turn roller 31. Upon confirmation of pinched retention of the leading end of the recording medium M between the turn roller 31 and the driven rollers 30, the turn roller 31 is stopped, after which the first movable guide 34 is switched over to the opened posture denoted with the virtual lines, whereby the recording medium M will be stored in a suspended condition within the inner space of the first loop-forming mechanism L1. Next, upon confirmation of the trailing end of the recording medium M fed from the printing unit Q1, the second movable guide 38 is set to the closed posture denoted with the solid lines and under this condition, the drive of the turn roller 31 and the drive of the feed roller 39 are initiated, thereby to feed the leading end of the recording medium M to the feed roller 39 of the second loop-forming mechanism L2 to be pinched by this feed roller 39 and fed into the heat fixing unit Q3 at the same speed as the transporting speed of the recording medium M at the heat fixing unit Q3. While this process is going on, the second movable guide 38 is switched over to the opened posture denoted with the virtual lines and then the turn roller 31 is driven to rotate at the high speed, so that the recording medium M stored at the first loop-forming mechanism L1 is gradually stored in a suspended condition in the inner space of the second loop-forming mechanism L2. When the recording medium M of the first loop-forming mechanism L1 is sent into the second loop-forming mechanism L2, the control operation again proceeds to feed the recording medium M from the printing unit Q1 into the first loop-forming mechanism L1 in the same manner as described above.

Further, in order to allow direct feeding of the recording medium M into the heat fixing unit Q3 from the outside, this loop-forming unit Q2 includes a hand-feeding section comprising a pair of guide plates 45. This allows, for instance, heat fixing of a recording medium M which was printed with image information by a printer or the like installed at a position away from this image forming system Q. Incidentally, the introduction guide 32 can be switched over to a discharging posture denoted with virtual lines by a manual operation. With this switchover to the discharging posture, the recording medium M printed at the printing unit Q1 or a print paper which was printed with a standard ink (a non-sublimating type ink) can be taken out. In this construction, it is also possible to provide the hand-feeding section with a shutter opened and closed in response to a control signal so as to inhibit feeding of a further recording medium M from the hand-feed section while a recoding medium M is being transported at the loop-forming unit Q2 or with a warning lamp for indicating to an operator presence of the recording medium M at the loop-forming unit Q2.

[Heat Fixing Unit]

As shown in FIG. 2 and also in FIGS. 6-9, the heat fixing unit Q3 includes, inside its main case 50, a heating case 51 formed of insulating material and adapted for heating the recording medium M, a blower case 52 (an example of an air heating section) formed also of insulating material and disposed at an upper position of the heating case 51 for supplying hot air to this heating case 51, a smoothing-out section D smoothing out or flattening the recording medium M fed from the heating case 51 by coming into contact with this medium M, and a support leg 53 for supporting the main case 50. Incidentally, this heating case 51 and the blower case 52 together constitute a heating unit.

In a heating space R formed within the heating case 51, there are provided a pair of pinching type introduction rollers 54 disposed adjacent the entrance for the recording medium M and on the downstream of the introduction rollers 54, there is provided a heating transporting mechanism including a plurality of double-face contact rollers 55 for coming into contact with the upper and lower faces of the recording medium M for applying a transporting force thereto and a plurality of upper-face contact rollers 56 for coming into contact with the upper face of the recording medium M for applying a transporting force thereto. And, at positions downwardly of the transport passage for the recording medium M by this heating transporting mechanism and at transportation-wise upstream and downstream positions, flat guide members 57 are provided for guiding the recording medium M by coming into contact with the lower face thereof. On the bottom face of each guide member 57, there is provided a sheet heater 58 for heating the guide member 57. Further, the double-face contact rollers 55 include a pair of upper rollers 55T and a single lower roller 55B arranged in a zigzag pattern in a side view (as viewed along the axial direction) with the outer peripheral faces of the upper rollers 55T and the outer peripheral face of the lower roller 55B defining there between a distance set to be substantially equal to the thickness of the recording medium M as viewed from the direction along the transporting direction of the recording medium M, so that the upper rollers 55T and the lower roller 55B lightly contact the recording medium M for providing a transporting force thereto. Incidentally, as the double-face contact rollers 55 transport the recording medium M by contacting it, deformation will hardly occur in the recording medium M even when the medium M is thermally expanded in its width, direction; and also as the double-face contact rollers 55 are disposed in light contact with the recording medium M, temperature distribution irregularity in the recording medium M too can be avoided. And, by adjusting the positional relationship between the pair of upper rollers 55T and the single lower roller 55B together constituting the double-face contact rollers 55 as desired, it becomes also possible to effectively cope with various thicknesses of a variety of recording media M. Further, as the outer peripheral face of the upper-face contact rollers 56 and the upper face of the guide member 57 define there between a distance substantially equal to the thickness of the recording medium M, the upper-face contact rollers 57 come into light contact with the upper face of the recording medium M for providing a transporting force to the recording medium M.

The introduction rollers 54, the double-face contact rollers 55, and the upper-face contact rollers 56 comprise metal shaft members 54A, 55A, 56A all having foamed silicone rubber having good heat resistance on the outer peripheries thereof. These rollers will be collectively referred to as transport rollers. In constructing each of these transport rollers, it is also possible to place a foamed silicone rubber tube over and around the drive shaft 54A, 55A, 56A and fixedly bonding them together. With such construction, the hardness of the outer periphery of the transport roller is reduced, thereby to decrease the pressure per unit area when the roller is pressed against the recording medium M and also to provide increased friction for realizing reliable transport. Further, the guide member 57 is made of such material as stainless steel, aluminum, titanium or the like having heat conductivity of 0.02 cal/cm/sec/° C. or more and a heat expansion ratio of $24\times10^{-s}$ cm/° C. or less, and a plate thickness of 0.8 to 50 mm. Each of the pair of sheet heaters 58 comprises a sheath heater (not shown) embedded in e.g. silicone rubber having good heat resistance and a guide temperature sensor Sa disposed at the center of the sheet heater 58 for determining the temperature of the guide member 57.

Inside the blower case 52, there are provided a pair of electric heaters 60 (an example of heater body) in the form of a plurality of rods and a pair of crossflow fans 62 (an example of a blower mechanism) supported about an axis extending parallel with the width direction of the recording medium M and rotatably driven by fan motors 61 disposed at width-wise opposed ends of the recording medium M for supplying hot air thereto. This blower case 52 defines, in its bottom face, an outlet E located immediately below the crossflow fan 62 for discharging hot air and an inlet F located downstream on the transporting passage for the recording medium M by the heating transporting mechanism. Adjacent the aperture of the outlet E, there are provided a pair of air sensors Sb in correspondence with the respective crossflow fans 62. Incidentally, by controlling means, (not shown) power is supplied to the electric heater 60 so that the respective air temperature sensors Sb may sense temperature of 180° C. and power to the sheet heater 58 is supplied so that the upstream guide sensor Sa may sense temperature of about 150° C. and also the downstream guide temperature sensor Sb may sense temperature of about 180° C.

When the recording medium M is heated, the two fan motors 61 are driven at one time for driving the two electric heaters 60 simultaneously, whereby the hot air heated inside the blower case 52 is discharged through the outlet E to a position transportation-wise downstream of the recording medium M inside the heating ease 51 for a feeding width greater than the entire width of the recording medium M, so that this hot air is caused to flow in the heating space R toward the transportation-wise upstream side along the transporting passage of the recording medium M. Then, the air is drawn into the blower case 52 through the inlet F at a position transportation-wise upstream of the recording medium M to be heated by the electric heater 63. After this, the heated air is supplied to the crossflow fans 62. In this way, the heated air is circulated. In the course of the heating process described above, if a difference is developed between the temperatures sensed by the pair of air sensors Sb, then, based on this temperature difference, the power to be supplied to the corresponding electric heater 60 is controlled and also the driving speed of the fan motor 61 is controlled, thereby to reduce the temperature difference.

Figure 12:
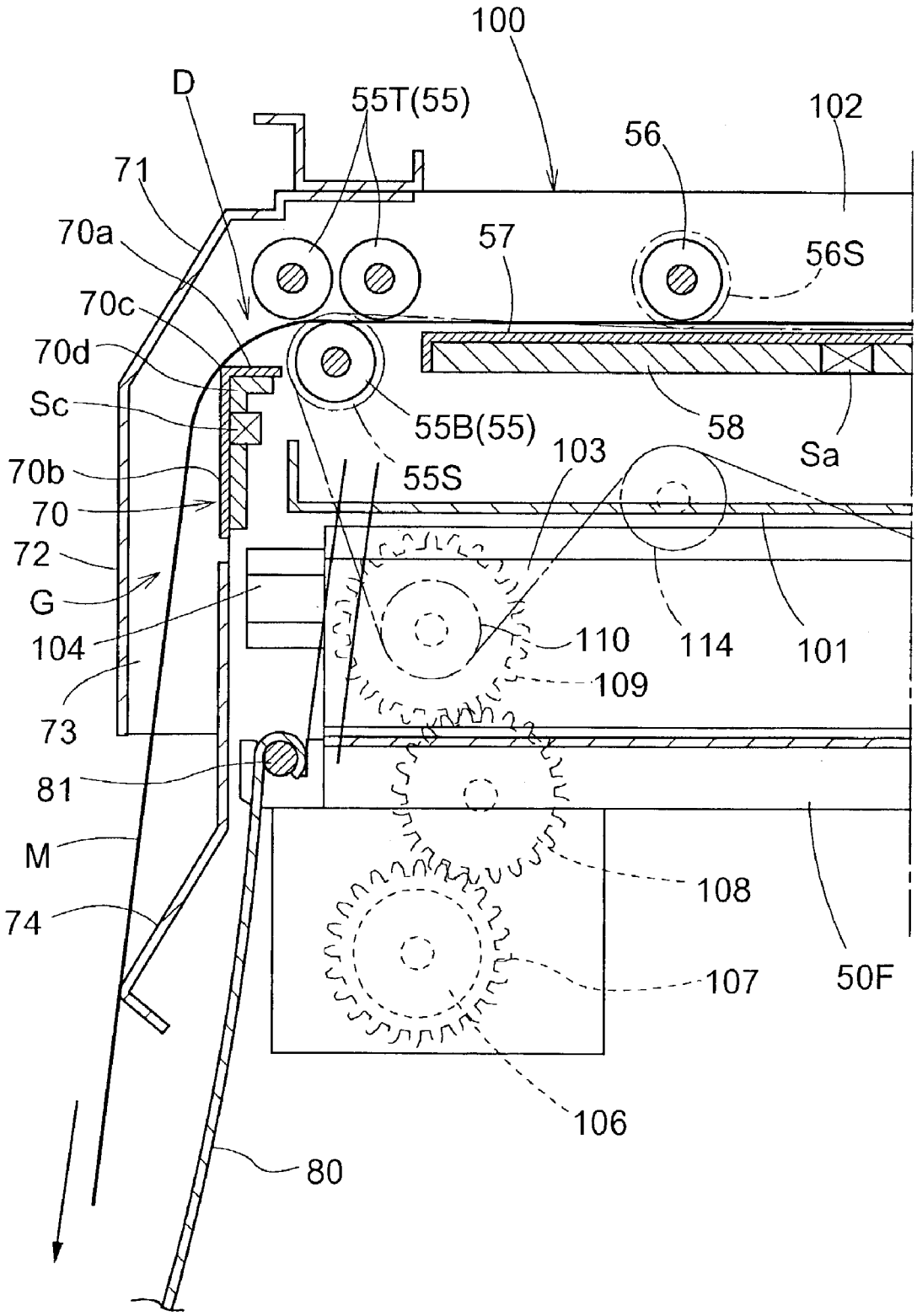
FIG. 12 is a side view in vertical section showing a construction of smoothing-out section.
Figure 13:
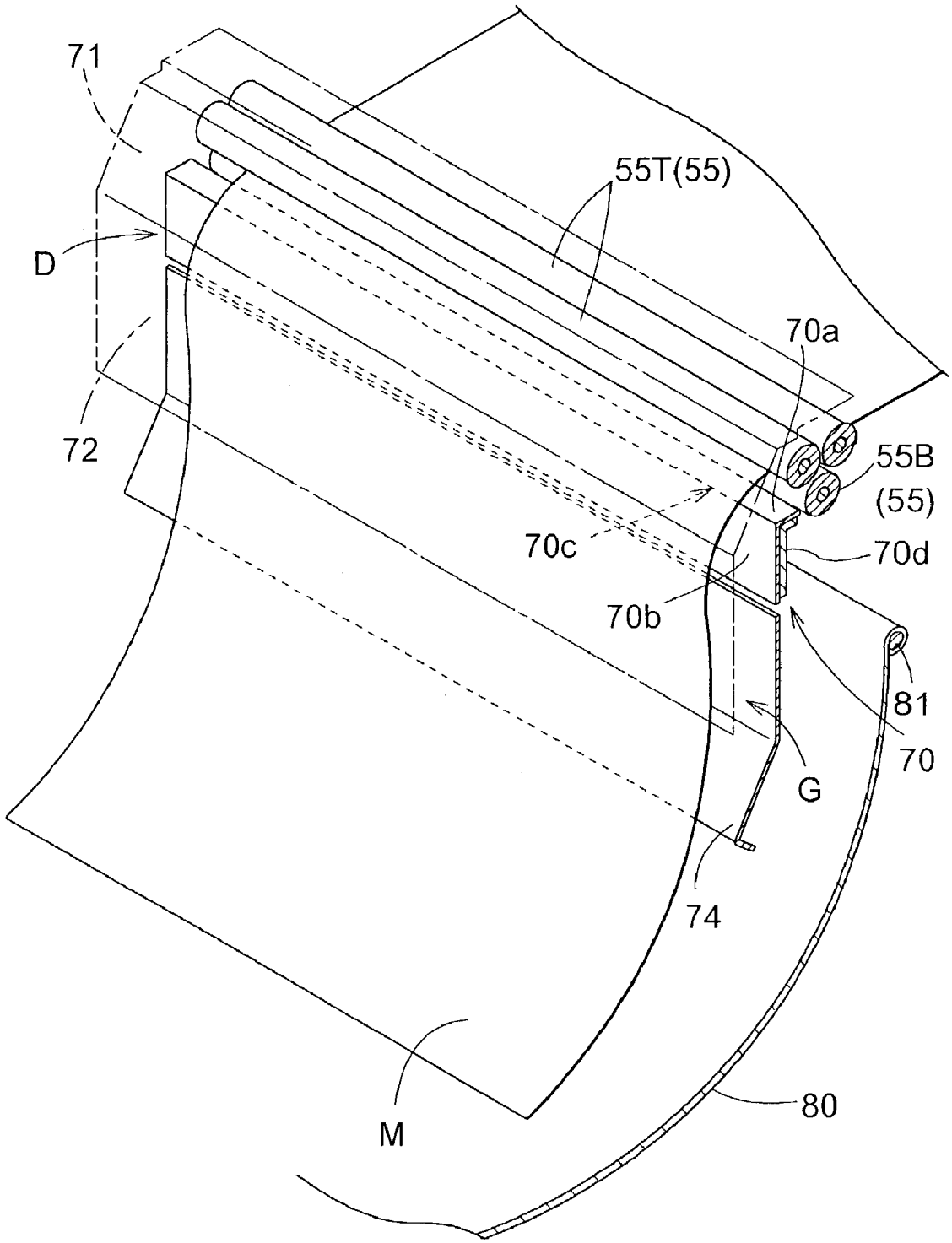
FIG. 13 is a perspective view showing the smoothing-out section.

The smoothing-out section D includes, relative to the discharging section of the heating transporting mechanism (the position of the double-face contact rollers 55 disposed at the terminal end of the transport) and along the transporting direction of the recording medium M discharged from this discharging section a curved transport passage G for guiding the transportation-wise downstream portion of the recording medium M discharged from this discharging section downwardly along the transporting direction and a heating member 70 for heating the recording medium M at this curved transport passage G along the width of the transporting direction. Specifically, as shown in FIGS. 12 and 13, the curved transport passage G includes a first guide face 71 inclined at a lower portion thereof away from the discharging section, a second guide face 72 vertically disposed for feeding the recording medium M downward and side walls 73 with the faces and the wall together forming a space open at the bottom, and a guide member 74 provided downwardly of this space for coming into contact with the recording medium M for adjusting of correcting the curved posture of the recording medium M.

The heating member 70 includes an upper wall 70*a* disposed parallel with the discharging direction of the recording medium M from the discharging section, a rear wall 70*b* disposed vertically as a position continuous from the upper wall 70*a* and a corner portion 70*c* formed at the border between the upper wall 70*a* and the rear wall 70*b*. This heating member 70 further includes a smoothing-out section temperature sensor Sc, and the power to be supplied to the electric heater 70*d* is controlled so that this smoothing-out section temperature sensor Sc may constantly sense a temperature of 180° C.

At this smoothing-out section D, the recording medium M fed with the horizontal posture after the heat fixing process thereof inside the heating case 51 is fed downwardly with a curling along the transporting direction at the curved transport passage G. At the same time, the corner portion 70*c* of the heating member 70 is brought into positive contact with the lower face of this recording medium M, thereby to allow the corner portion 70*c* to provide a force in a concentrated manner against the lower face of the recording medium M. With this, even if deformation has occurred in the recording medium M in the course of the heat fixing process inside the heating case 51 (heating space R), such deformation may be effectively eliminated by the contact with the corner portion 70*c* which are formed straight and are also heated to 180° C. As a result, the section D may feed the recording medium M in a smoothed out condition.

In order to receive the recording medium 1 discharged from the smoothing-out section D, there is provided a stocker 80 made of cloth and inclined with its leading end disposed downward. As shown in FIGS. 1 and 2, this stocker 80 has a width greater than the maximum width of the recording medium 1 which can be processed by the heat fixing section and is formed of polyester cloth having high heat resistance and interwoven with carbon fibers having conductivity for eliminating static electrical charge. Also, this stocker 80 has its top end supported to a horizontal support rod 81 and has its bottom end supported to a bottom rod 82. The bottom rod 82 has its opposed ends supported by stays 83 extending from the support leg 53 of the heat fixing section. With this, the stocker 80 is inclined downwardly in a direction farther from the heat fixing section Q3.

As shown in FIG. 2, in order to collect odorous substance such as mist or gas leading from above the curved transport passage G of the smoothing-out section D or from the open bottom thereof, there is provided a duct 90 at a position upwardly of the smoothing-out section D, with the duct being open at the bottom thereof. Further, there are provided an electric-powered fan 91 for sucking the mist or gas collected by this duct 90 and an eliminating section H having an eliminating mechanism 92 for eliminating the mist or the gas from the electric powered fan 91. This eliminating mechanism 92 may be adapted for eliminating the odor by adsorbing the mist or gas or by a chemical reaction therewith or by activity of microorganism. Specifically, the mechanism can comprise activated carbon, silica gel, zeolite, calcium silicate, ozone deodorizer, photocatalytic device, scrubbing deodorizer, etc.

The transport rollers excluding the introduction rollers 54, the transmission mechanism for providing rotational drive to these transport rollers, the guide member 74 and the smoothing-out section D are all supported via a slide frame 100 to the main case 50. The slide frame 100 is slidable toward the downstream side in the transporting direction of the recording medium M. That is to say, as shown in FIGS. 6 through 11, the slide frame 100 includes a pair of transmission cases 102 disposed at opposed ends of the transport rollers, a bottom wall 101 disposed at position interconnecting these transmission cases 102, and a frame interconnecting these components. And, this slide frame 100 is supported to be switchable by a sliding operation thereof between a condition where the frame is drawn out on the side of the rear face of the main case 50 (see FIG. 8) and a further position where the frame is set and stored within the main case 50 (see FIG. 7). In order to realize this sliding operation, a pair of guide rails 103 are supported in parallel with the transporting direction of the recording medium M and wheels 104 guided by the guide rails 103 are rotatably supported to the transmission case 102.

A transport motor 106 is provided downwardly of the main case 50. An intermediate gear 108 meshing with an output gear 107 of this transport motor 106 is supported to the main case and an input gear 109 meshing with this intermediate gear 108 is supported to one side face of the transmission case 102. The transmission case 102 accommodates therein an input sprocket 110 rotatable in unison with the input gear 109, a sprocket 55S mounted at an end of the drive shaft 55A of the lower roller 55B of the double-face contact roller 55, a sprocket 56S mounted at an end of the drive shaft 56A of the upper-face contact roller 56, an endless chain 112 for transmitting force to these sprockets 110, 55S, 56S, and a tension wheel 114 pivoted to a pivot arm 113 for providing a tension to the endless chain 112. Further, at the ends of the respective roller drives shafts 55A, coupling gears 115 meshing with each other are provided for rotating the double-face contact rollers 55 in synchronism relative to this transmission case 102 and the other transmission case 102.

Figure 10:
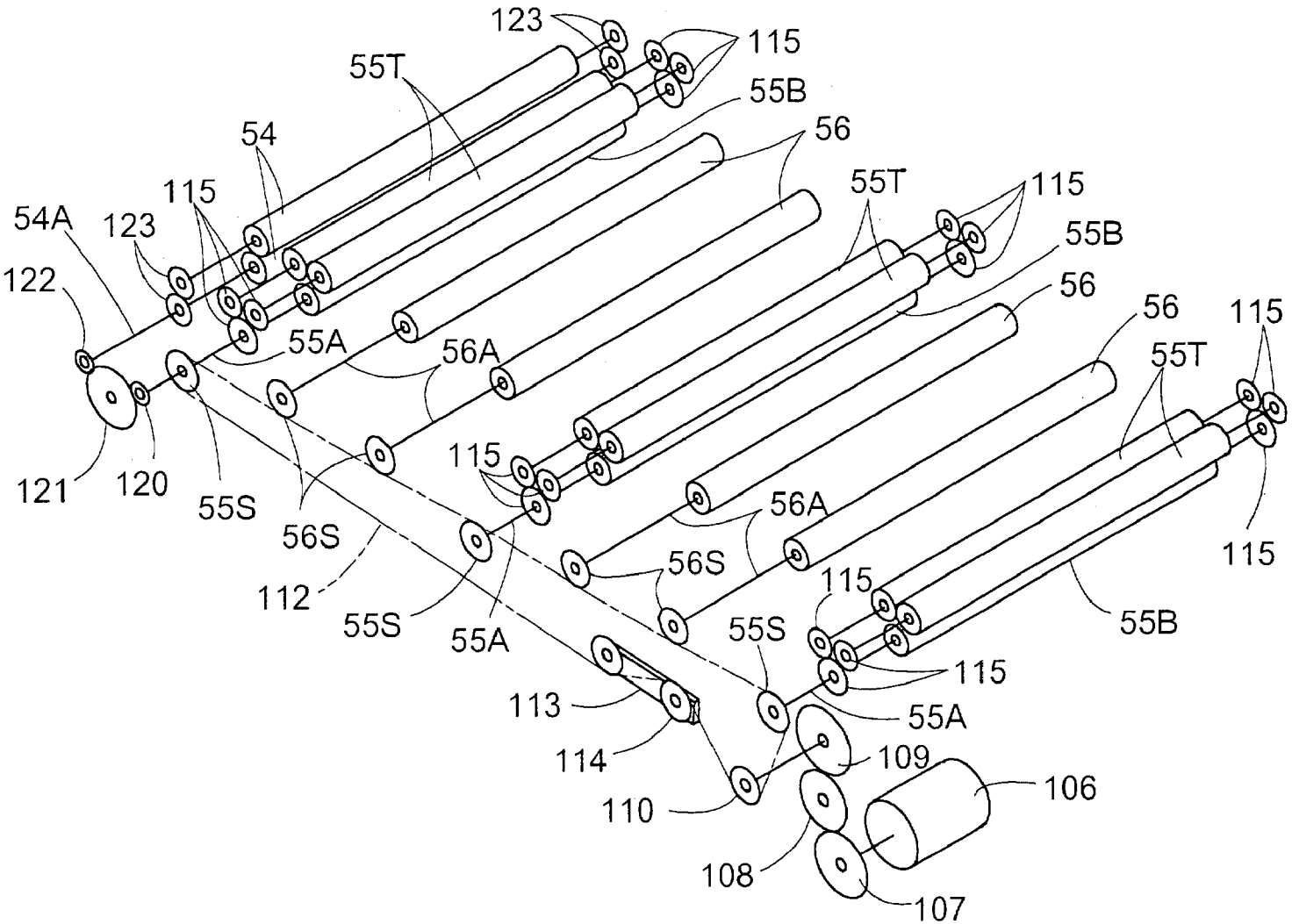
FIG. 10 is a perspective view showing principal portions of a transmission line of a heating transporting mechanism.
Figure 11:
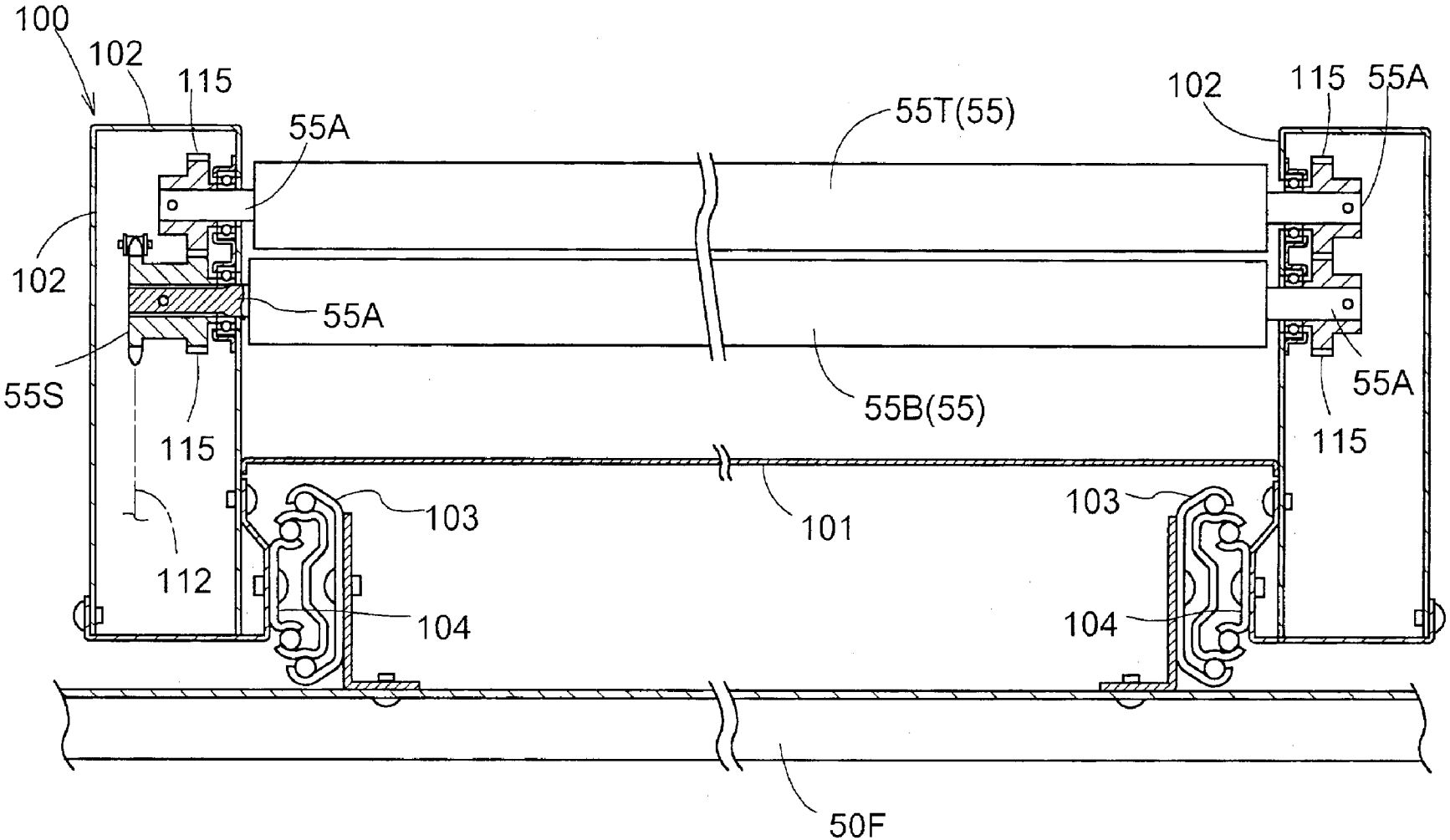
FIG. 11 is a front view in vertical section showing arrangement of a transmission case of the heating transporting mechanism.
Figure 14A:
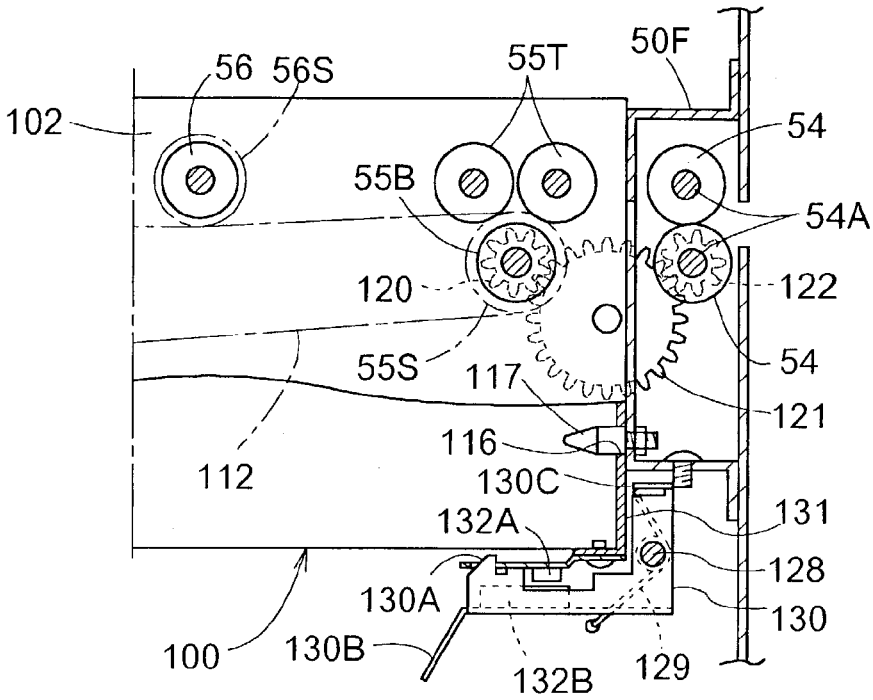
FIGS. 14A–B are side views in vertical section showing an end of the slide frame at its connected position arid its detached position, respectively.
Figure 14B:
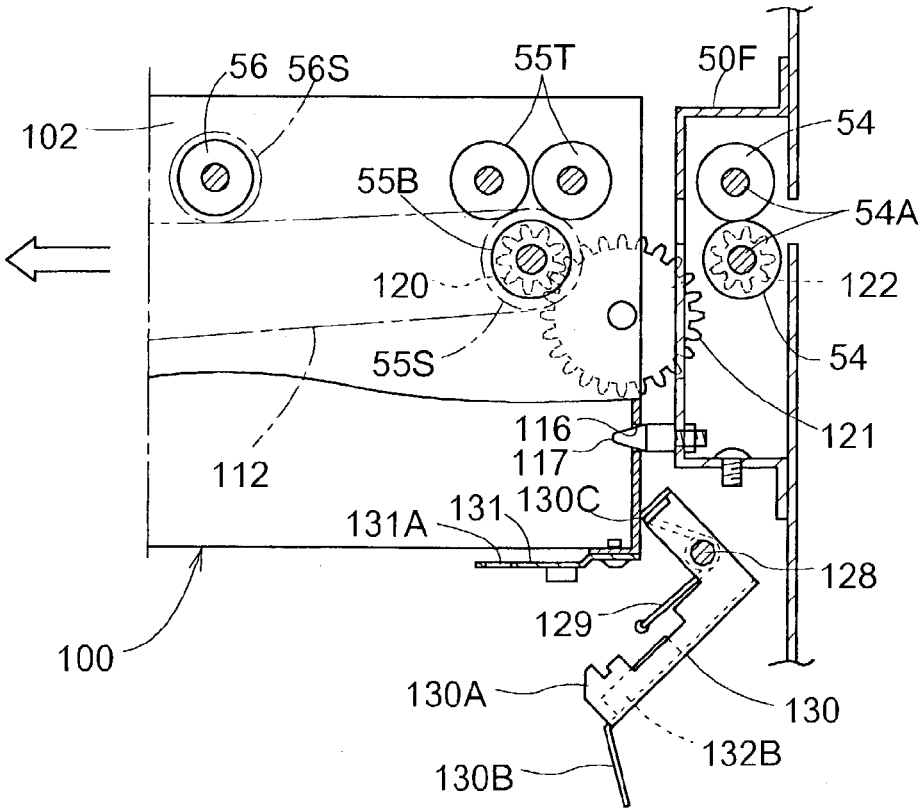

As shown in FIGS. 10 and 14, a gear 120 is provided to be rotatable in unison with the sprocket 55S disposed transmission-wise upstream of the recording medium M. A transmission gear 121 meshing with this gear 120 is supported to the slide frame 100 and this transmission gear 121 is meshed also with a driven gear 122 mounted at an end of the drive shaft 54A of the introduction roller 54, and a coupling gear 123 is provided for meshing with the respective drive shafts 54A.

Figure 7:
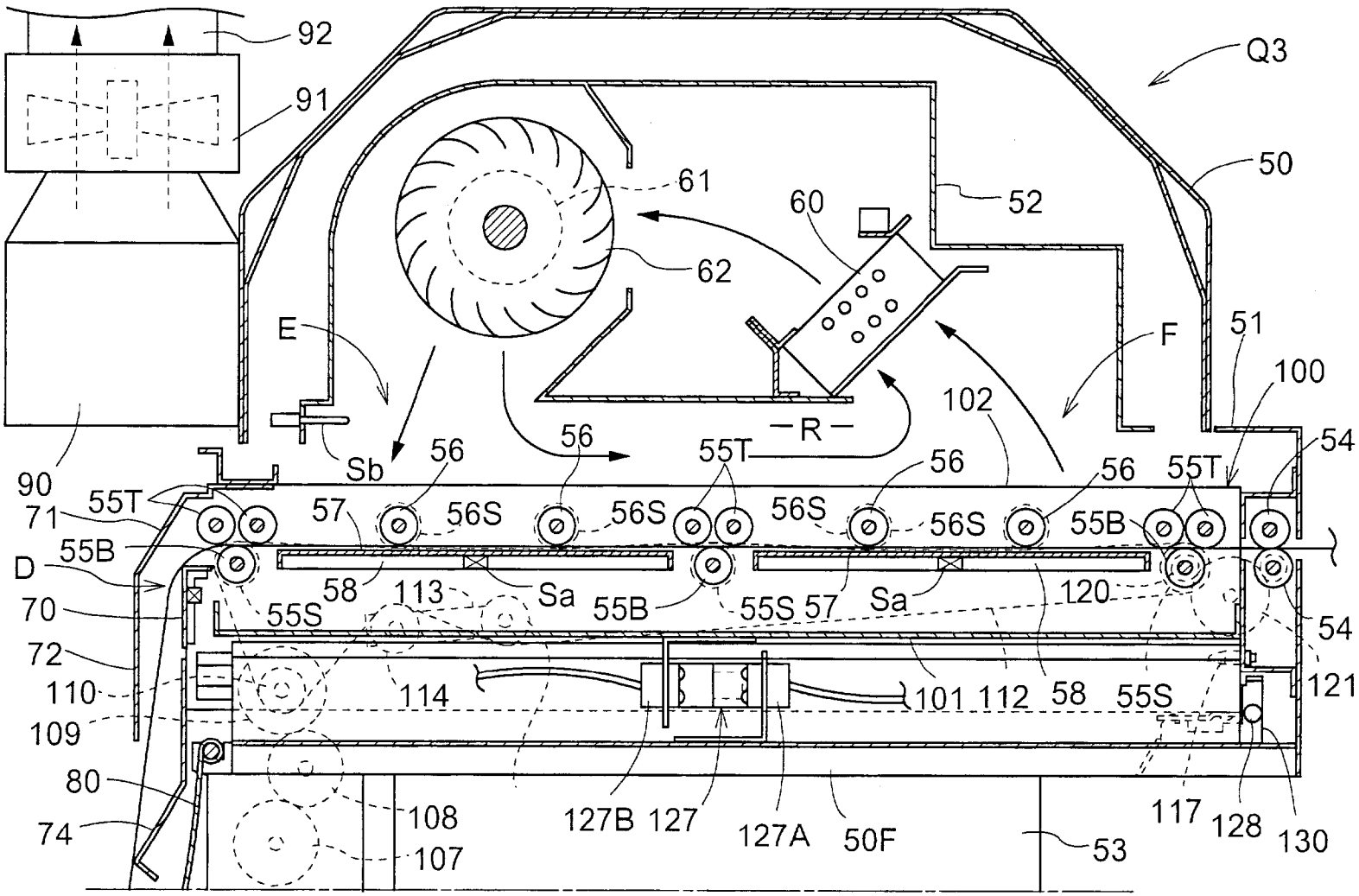
FIG. 7 is a side view in vertical section of the heating fixing unit.
Figure 8:
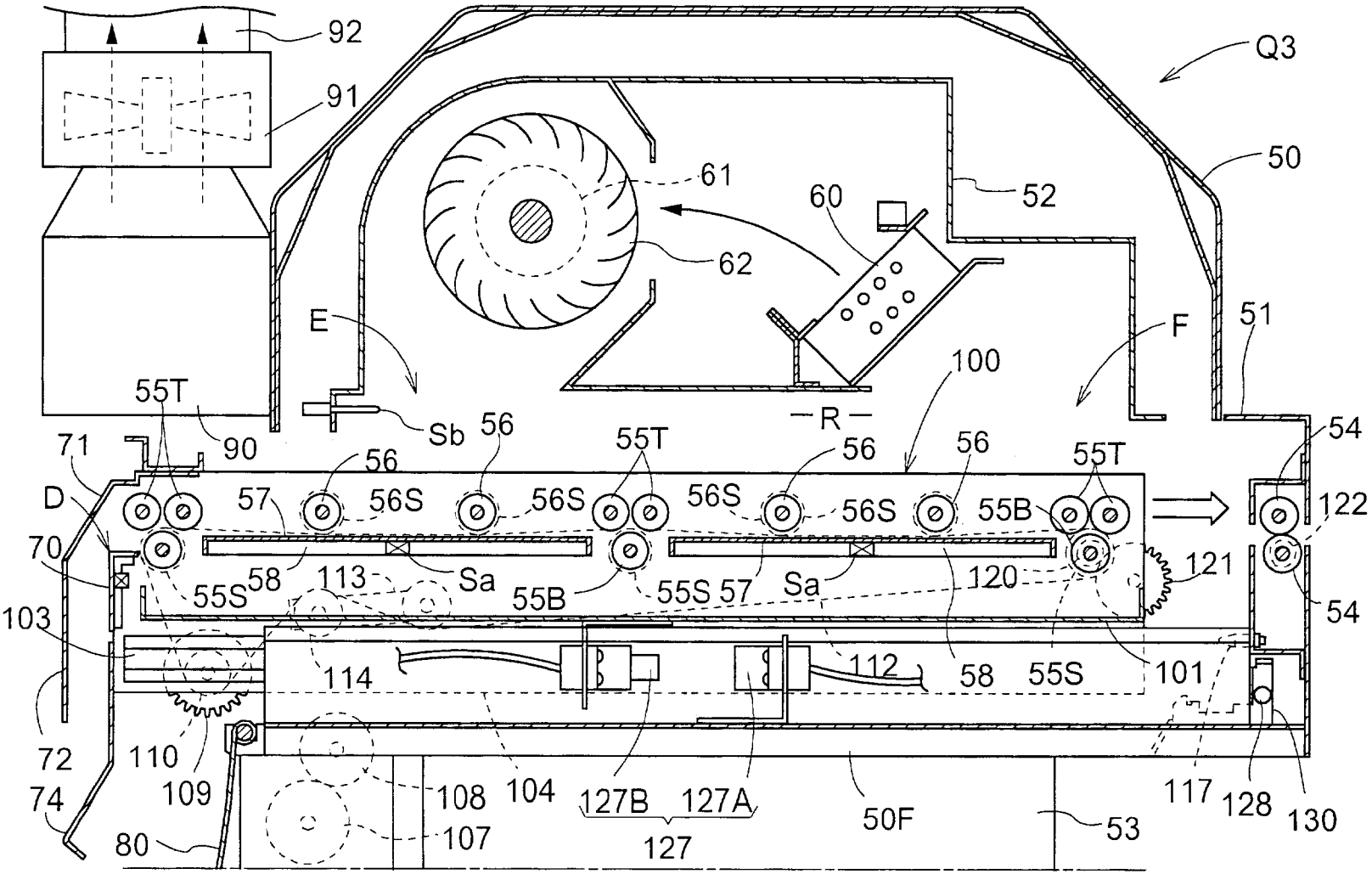
FIG. 8 is a side view in vertical section of the heating fixing unit under a condition in which a slide frame is slid.
Figure 9:
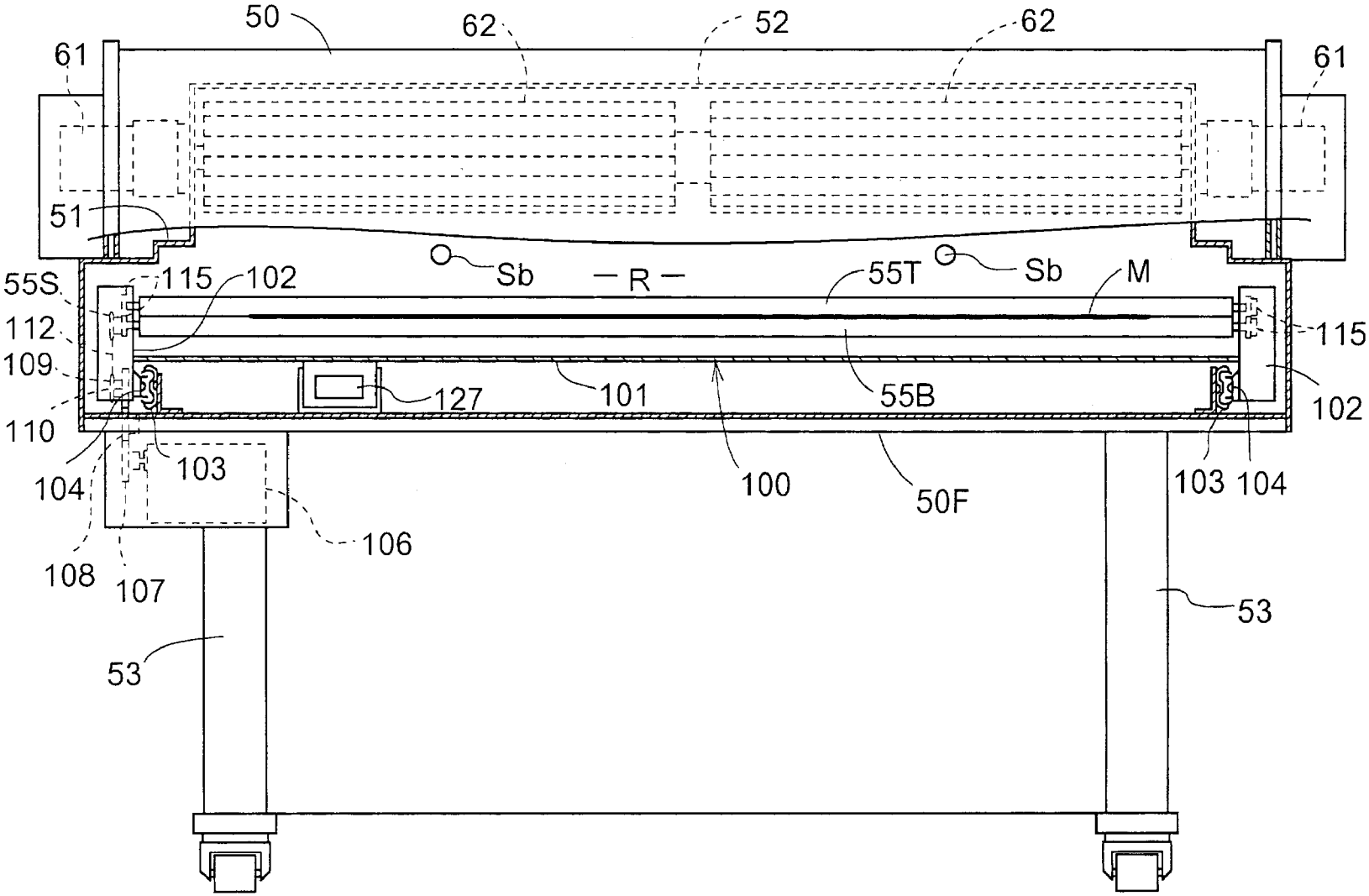
FIG. 9 is a front view in vertical section of the heating fixing unit.

As shown in FIGS. 7 and 8, between the lower face of the slide frame 100 and a frame 50F of the main case 50, there is provided a drawer connector 127. This drawer connector 127 includes a stationary connector 127A supported to the frame 50F of the main case 50 and a slide connector 127B supported to the slide frame 100. These connectors of the drawer connector 127 are separated from each other when the slide frame 100 is drawn out and are engaged and electrically connected with each other when the slide frame 100 is set to a connecting position shown in FIG. 7. Incidentally, the power to be supplied to the sheet heater 57 via this drawer connector 127 and the signal line for the guide temperature sensor Sa for determining temperature of the guide member 57 are connectable to and detachable from each other.

As shown in FIG. 14, the slide frame 100 define an engaging hole 116 at a position upstream in the transporting direction of the recording medium M. Whereas, the frame 50F of the main case 50 includes a positioning pin 117 projecting therefrom to be inserted to and withdrawn from the engaging hole 116. As shown, a lock arm 130 is supported to be pivotable about a support shaft 128 relative to the frame 50F of the main case 50, with the arm 130 being urged in a locking direction. This lock arm 130 integrally includes a lock piece 130A provided at the leading end thereof, an operating portion 130B to be operated by an operator and a contact portion 130C formed at the base end of the arm 130. The slide frame 100 includes a lock plate 131 defining a lock hole 131A engageable with the lock piece 130A. And, at a position where the lock arm 130 and the lock plate 131 are opposed to each other, there is provided a proximity switch 132 consisting of a magnet 132A and a lead switch 132B. This proximity switch 132 electrically detects the condition of the lock arm 130. Though not shown, when the lead switch 132B detects lock-released condition, a relay (not shown) incorporated in the power supply system is activated for cutting off the power to be supplied to the drawer connector 127 from the main case.

With the above-described construction, for drawing out the slide frame 100, the lock arm 130 is operated to its lock releasing position shown in FIG. 14(*b*), so that the contact portion 130C formed integrally with this lock arm 130 presses the end of the slide frame 100, thereby to slightly slide this slide frame 100. Under this condition, the relay is energized for cutting off the power to the drawer connector 127. Then, when the operator manually draws out the slide frame 100, the drawer connector 127 is completely detached, so that the intermediate gear 108 and the input gear 109 are disengaged and also the transmission gear 121 and the gear 121 are disengaged, whereby the slide frame 100 now can be drawn out to full. Under this drawn out condition, checking, maintenance operations of the transmission system as well as removal of jammed recording medium M can be carried out easily. After this, when the slide frame 100 is pushed back into the main case, the intermediate gear 108 and the input gear 109 are meshed with each other and also the transmission gear 21 and the gear 122 are meshed with each other, so that the power from the transporting motor 106 can now be transmitted and also the drawer connector 127 reaches its connected condition for allowing transmission of power and signal. And, as shown in FIG. 14(*a*), the lock piece 130A of the lock arm 130 comes into engagement with the lock hole 131A of the lock plate 131 to provide a locked state and the slide frame 100 is locked.

In operation of the image forming apparatus Q having the above-described construction, the following control operation is effected when this image forming apparatus Q effects image transfer or fixation to the recording medium M. Namely, the transport mechanism A of the printing unit Q is driven to transport the recording medium M to the position of the print head 22. Under this condition, the print head 22 is driven to print the image information on the surface layer 13 of the recording medium M with the sublimating ink. In this printing of the image information on the recording medium M, if the image information to be printed is significantly large, the leading end of the recording medium M printed with the image information will discharged through the outlet 20A of the printing unit Q1 into the loop-forming unit Q2. Also, if the image information printed with the image information at the printing unit Q1 is to be cut, when the position of the recording medium M where the medium is to be cut has reached the cutting position of the cutter mechanism B, the print head 22 is operated in the main scanning direction with its blade body 28 being projected toward the medium, whereby the recording medium M will be cut off. And, this cut-off portion of the recording medium M becomes the trailing end of the recording medium M and the other cut-off portion located inside the printing unit Q1 becomes the leading end of the recording medium M to be fed next.

Also, when the recording medium M is discharged from the printing unit Q1, the leading end of this recording medium M will be sent to the turn roller 31 located at the center of the loop-forming unit Q2, where the leading end is pinched between the turn roller 31 and the driven rollers 30 and the subsequent length of the recording medium M will then be stored in a suspended condition at the first loop-forming mechanism L1. Upon detection of the trailing end of the recording medium M under this condition, the leading end of the recording medium M which has been pinched by the turn roller 31 will now be fed to the feed roller 39 of the second loop-forming mechanism L2, where the end is pinched by this feed roller 39. Then, as the turn roller 31 is driven at the high speed for feeding the recording medium M stored in the first loop-forming mechanism L1 to the second loop-forming mechanism L2, so that the length of the medium M will be stored in a suspended condition at the second loop-forming mechanism L2. In particular, in this loop-forming unit Q2, the recording medium M is transported as being wound about the turn roller 31 and this winding direction of the recording medium M about the turn roller 31 is opposite to the winding direction of the recording medium M set in the roll stage at the printing unit Q1. Therefore, curling tendency in the recording medium may be effectively eliminated.

Next, in the heat fixing unit Q3, upon receipt of the recording medium M from the feed roller 39 of the loop-forming unit Q2, this recording medium M is sent from the introduction rollers 54 into the heating space R inside the heating case 51. In this heating space R, as the medium M receives a transporting force from the transport rollers through contact therewith, the medium is sent downstream in the transporting direction. And, in the heating case 51, the upper face of the recording medium M is hated through contact with the hot air supplied with the width corresponding to the entire width of the recording medium M from the downstream side to the upstream side in the transporting direction and at the same time the lower face of this recording medium M is heated also through its contact with the guide member 57. Further, in this heating case 51, since on the downstream side of the transporting direction, the hot air has a higher temperature (180° C.) and the guide member 57 located on the downstream side of the transporting direction also has a higher temperature (180° C.), as the recording medium M is being transported, the temperature of this recording medium M will be raised slowly and the temperature will reach an appropriate value when the medium has reached the downstream end. Therefore, heat fixation or transfer may be realized with little thermal deformation in the substrate 11 or irregularity in the image information.

Upon completion of this heat fixing process, the recording medium M is set to the smoothing-out section D. In this section, as shown in FIG. 12, the recording medium M will be bent along the curved transport passage G having the first guide face 71 and the second guide face 72 and caused to come into contact with the corner 70*c* under this bent condition, whereby deformation if any in this medium may be eliminated. Then, the medium will be received and collected by the stocker 80. Incidentally, the eliminating mechanism 92 disposed upwardly of the smoothing-out section D functions to eliminate odor generated in the course of the heat fixing process, thereby to provide a comfortable environment.

[Other Embodiments]

In addition to the foregoing embodiment, the present invention may be embodied also in the following manners (in the following discussion of other embodiments, components having the same functions as those employed in the foregoing embodiment will be denoted with same reference marks or numerals).

(Second Embodiment)

Figure 15:
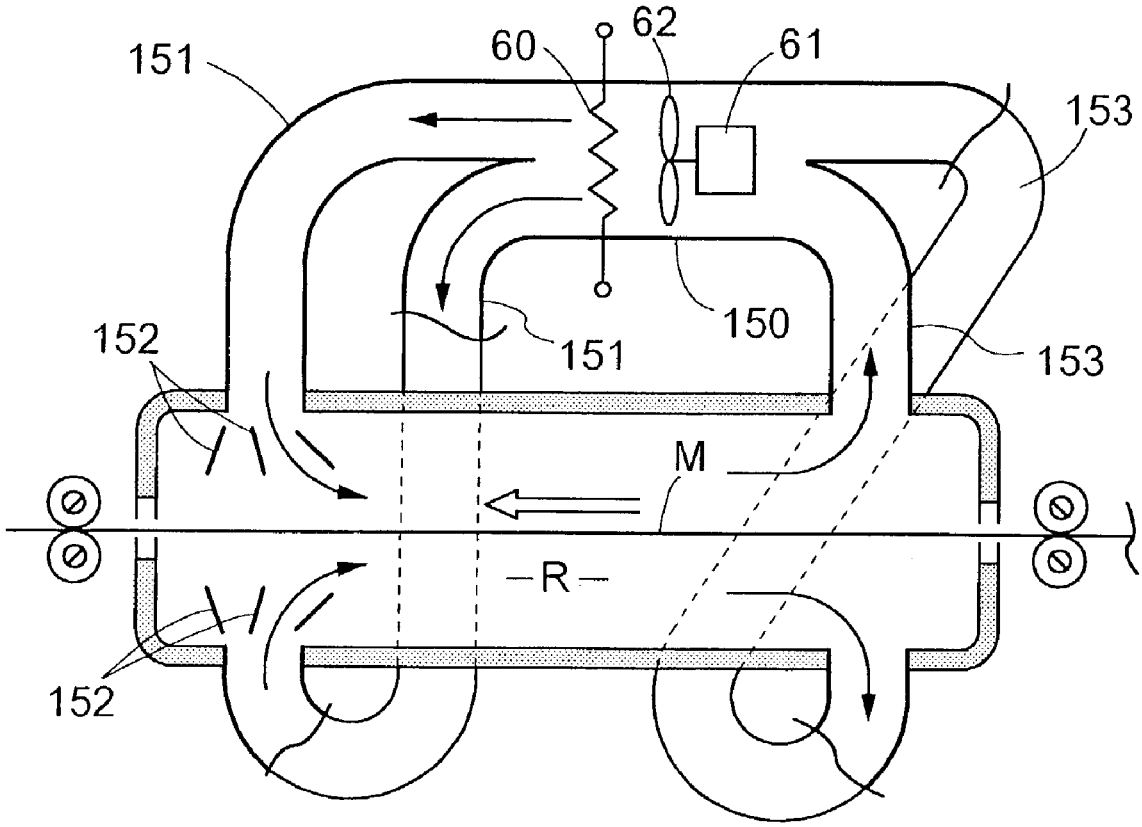
FIG. 15 is a side view in vertical section showing a heat fixing apparatus relating to a second embodiment.

As shown in FIG. 15, outside the heating space R, thee is provided an air heating chamber 150 including an electric heater 60 (an example of the heater body), a fan 62, and a fan motor 61. A pair of feed ducts 151 are provided for feeding hot air heated at this air heating chamber 150 to a space in the heating space R facing the transport passage from opposed sides thereof. A rectifier plate 152 is provided for uniformly distributing the hot air from the feed ducts 151 into the heating space R. Further, a pair of intake ducts 153 are provided for returning the air from the space of the heating space R opposing the transport passage from the opposed sides thereof back to the heating space R. These components together constitute a heating mechanism of this embodiment. With this construction adapted for feeding hot air to the heating space R by means of ducts, by creating the air current at a portion in the heating space R whose temperature is difficult to be raised, the temperature of the air inside the heating space R may be averaged positively, thereby to realize uniform heating. Incidentally, in this embodiment, more than three pairs of the feed ducts 151 and the intake ducts 153 may be provided respectively. With such increased number of ducts greater than three, even more uniform heating will become possible.

(Third Embodiment)

Figure 16:
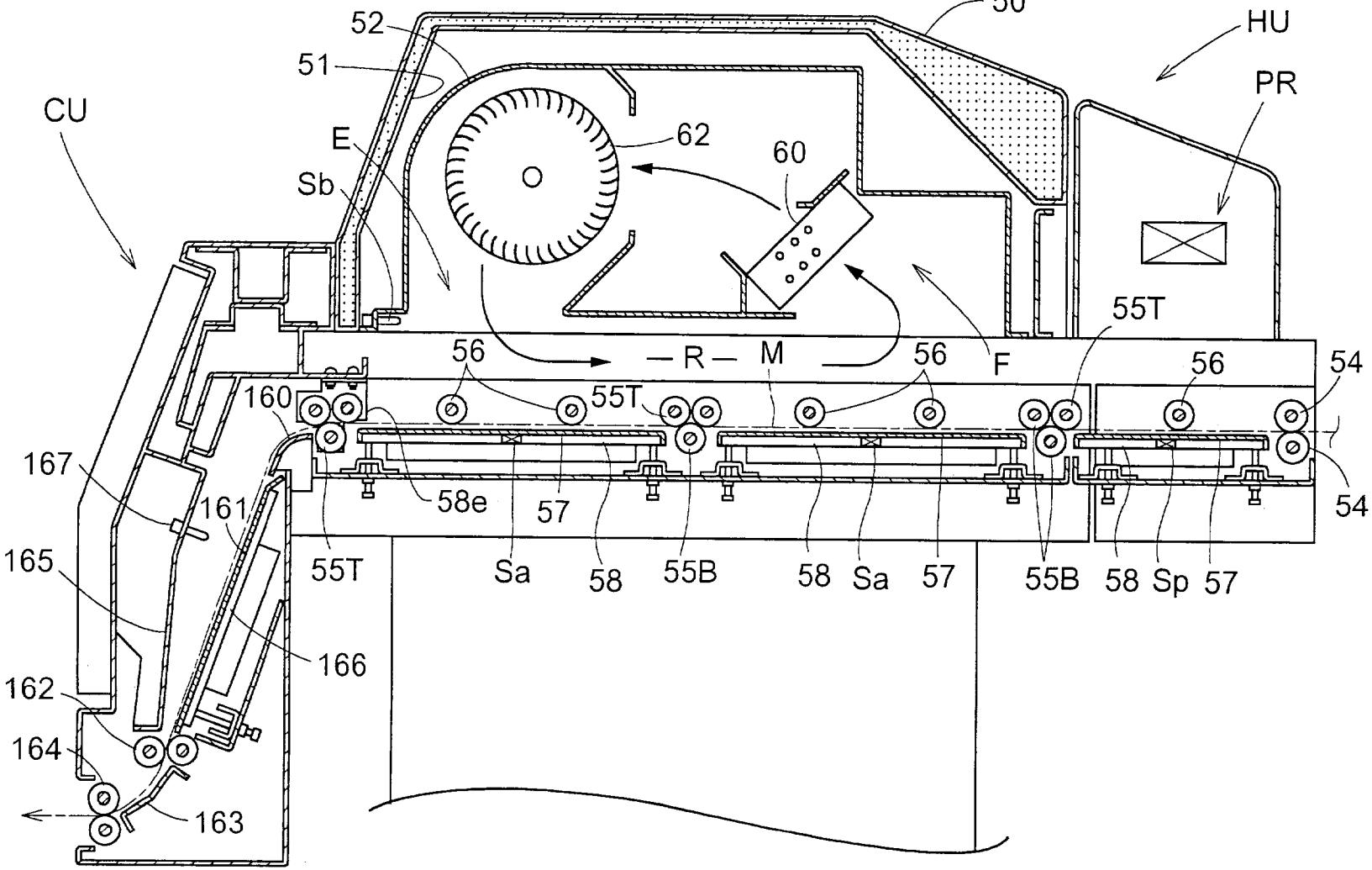
FIG. 16 is a a side view in vertical section showing a heat fixing apparatus relating to a third embodiment and a preliminary heating section and a slow cooling unit.
Figure 17:
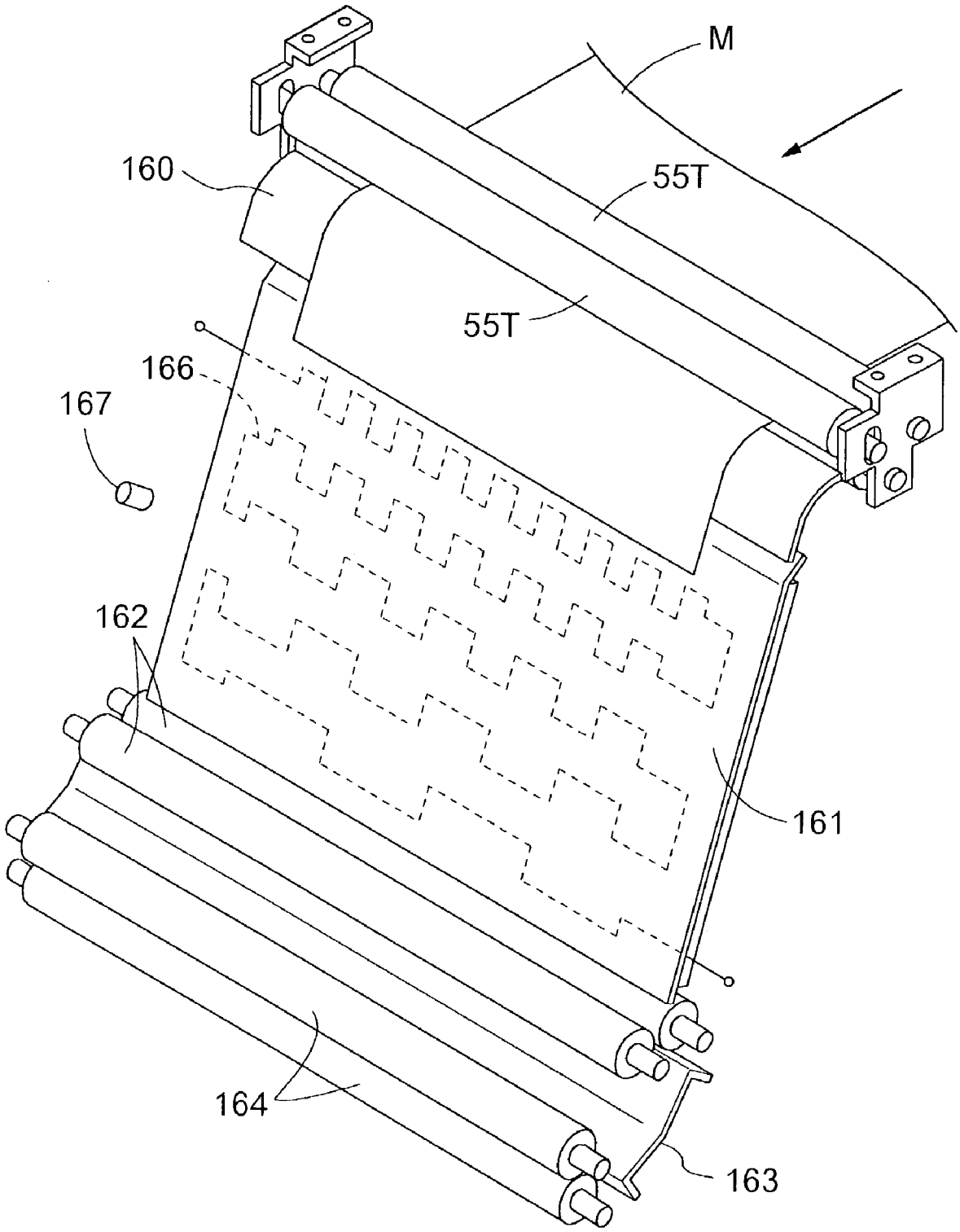
FIG. 17 is a perspective view showing construction of a slow cooling unit according to the third embodiment.

As shown in FIG. 16 and FIG. 17, a preliminary heating unit HU is provided in the transporting passage for feeding the recording medium M to the heating space R, and at a position where the medium M is discharged from the heating space, there is provided a slow-cooling unit CU.

That is, this further embodiment does not differ from the foregoing embodiment in the construction of heating the recording medium M at the heating space R formed inside the heating case 51. The preliminary heating unit HU forms a preliminary heating space PR, where a press type introduction roller 54 for feeding the recording medium M to this preliminary heating unit HU, an upper-face contact roller 56 for coming into contact with the upper face of the medium M fed into this preliminary heating space PR for providing a transporting force thereto, and a guide member 57 for contacting the lower face of the recoding medium M for transmitting heat thereto, are provided. On the lower face of the guide member 57, there are provided a sheet heat 58 for heating the guide member 57 and a fixing temperature sensor Sp for determining temperature of the guide member 57.

In this preliminary heating unit HU, the temperature of the sheet heater 58 is set sufficiently lower than the heating temperature at the heating space R. Then, the recording medium M is charged into the heating space after being heated preliminarily to the lower temperature by the heating at the preliminary heating unit HU. Therefore, even recording medium M having a low temperature can be speedily heated to the fixing temperature to realize sufficient transfer and fixation.

The slow cooling unit CU includes a curved transporting section 160 provided at the discharging side of the heating space R, a slow cooling guide member 161, slow cooling intermediate transporting roller pair 162, a turn guide 163, and press type discharging roller pair 164 and these components together constitute a slow cooling transporting line. This slow cooling transporting line is disposed inside a slow cooling space which is substantially closed by a slow cooling case 165. The slow cooling guide member 161 extends with a width exceeding the maximum width of the recording medium M so as to form an inclined guide face for coming into face contact with the recording medium M. The inclination of the inclined face is determined within a range between 20 degrees and 60 degrees relative to the vertical axis. To the rear face of the slow cooling guide member 161, there is mounted an electric wire type heater 166 acting as a heater capable of transmitting heat to this slow cooling guide member 161.

The heat to be transmitted from this heater 166 to the slow cooling guide member 161 is adjusted such that the temperature at the recording medium entrance of the slow cooling guide member 161 may be substantially equal to the temperature at the exit of the heating space R and also that the temperature at the recording medium exit of the slow cooling guide member 161 may be substantially equal to the room temperature and also the temperature gradient therebetween may form as mild as possible curve. With this, occurrence of deformation such as wrinkles in recording medium M during its cooling process may be effectively restricted.

As a predetermined electric current is supplied to this heater 166, in the slow cooling guide member 161, there is developed such temperature gradient described above effective for restricting occurrence of wrinkles, e.g. temperature gradient from about 180° C. to 20° C. This control of the power to be supplied to the heater 166 is effected with using, as feedback, the detection signal from a slow cooling temperature sensor 167 disposed directly at the intermediate area of the slow cooling guide member 161 or disposed upwardly of the guide face.

With the above-described construction, in heating the recording medium M, the medium is preliminarily heated at the preliminary heating unit HU, so that the elevation of the temperature to the fixing temperature may be speedily realized in the heating space R. After heating at this heating space R, heat is discharged from the medium slowly at the slow cooling unit CU. As a result, smooth finish may be obtained in the resultant recording medium with avoiding rapid change in temperature and associated deformation during the ink fixing on the recording medium M.

(Fourth Embodiment)

Figure 18:
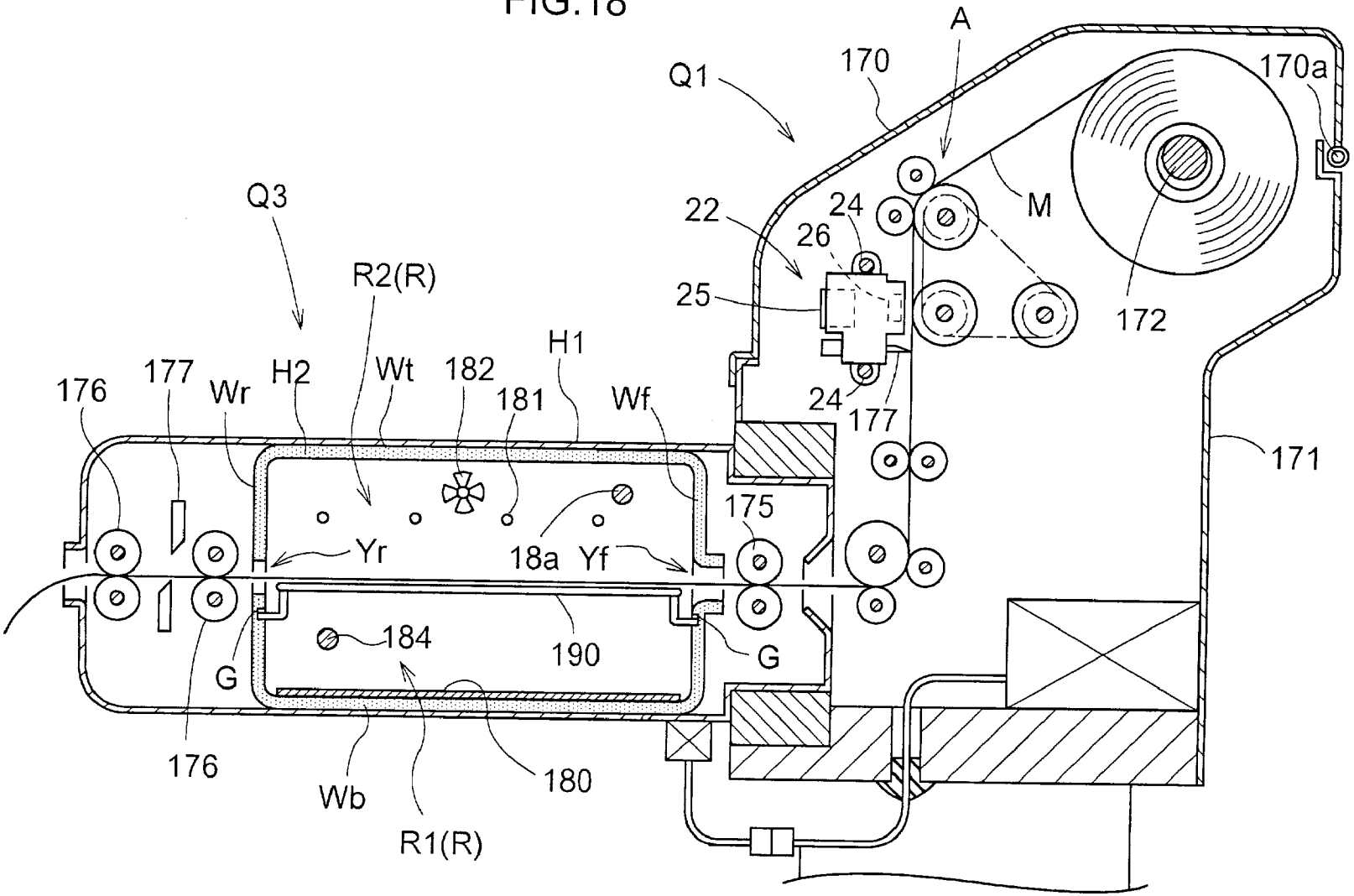
FIG. 18 is a side view in vertical section showing a printing unit and a heat fixing apparatus relating to a fourth embodiment.
Figure 19:
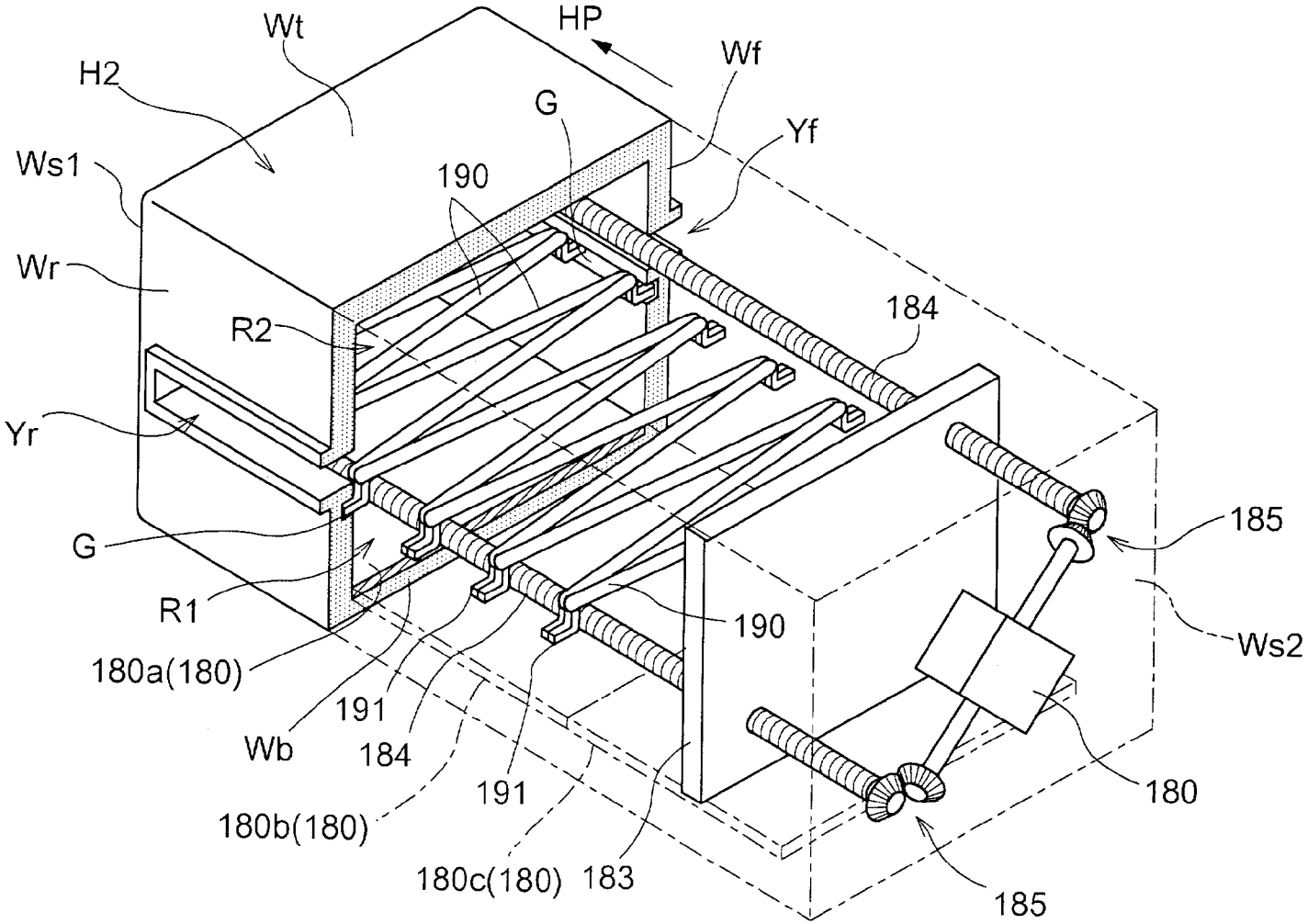
FIG. 19 is a perspective view showing inner construction of the heat fixing apparatus of the fourth embodiment.
Figure 20A:
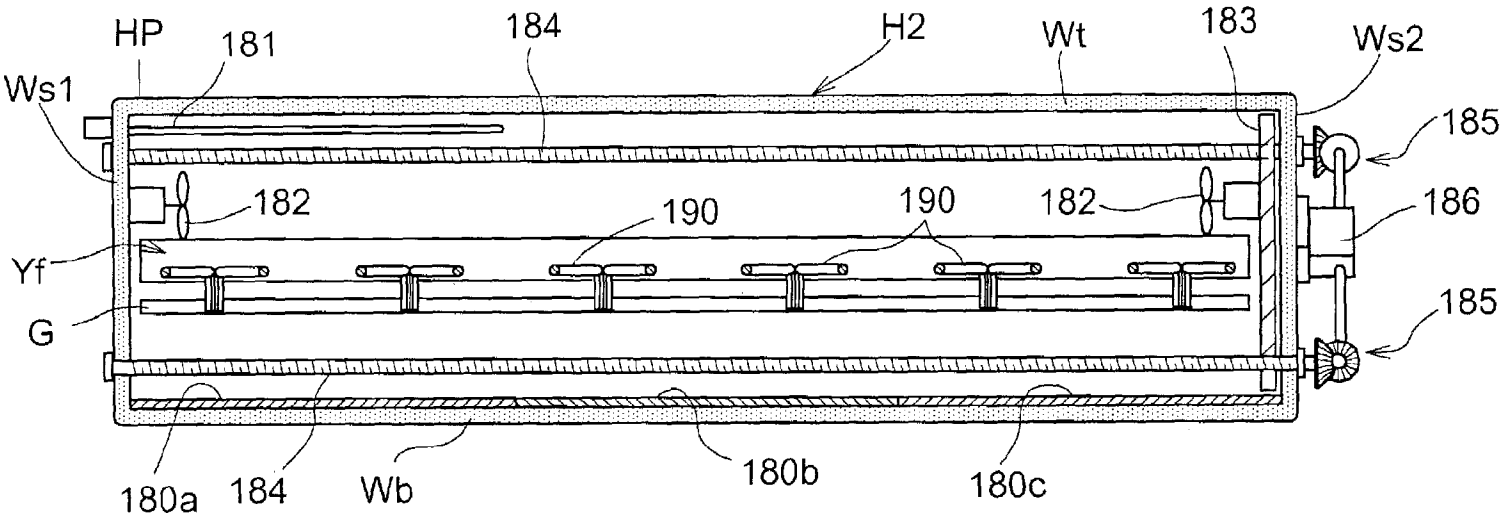
FIG. 20A is a section view illustrating a condition of the heat fixing apparatus of the fourth embodiment in which its heating area is set to the maximum.
Figure 20B:
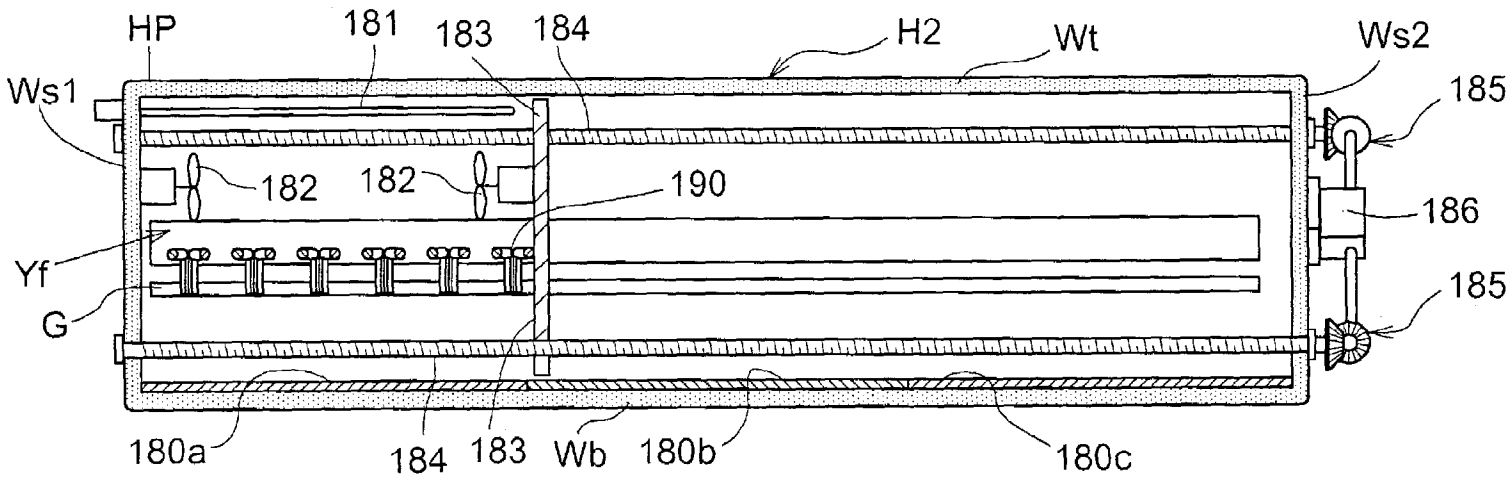
FIG. 20B is a section view illustrating a further condition of the heat fixing apparatus of the fourth embodiment in which its heating area is set to the minimum.

As shown in FIGS. 18 through 20, in this embodiment, the width of the heating area of the heating space R is rendered adjustable according to the width of the recording medium M. In this embodiment, the heat fixing unit Q3 (an example of heat fixing apparatus) is connected with the printing unit Q1.

More particularly, in the printing unit Q1, within a main body 171 having a cover 170 which can be pivotally opened/closed about a hinge 170*a*, a support rod 172 rotatably supports the recording medium M in the rolled state. The body 171 accommodates therein a pinching type transporting mechanism A for feeding the recording medium M and an inkjet type print head 22 for printing image information on the recording medium M transporting mechanism A with sublimating ink. This print head 22 is supported to be movable back and forth along a guide rod 24 oriented along the main scanning direction. The head 22 includes an ink cartridge 25 detachably attached to the head for storing the sublimating ink, a discharge mechanism 26 driven by piezoelectric elements, and a blade body 28 projectable and retractable relative to the head.

The heat fixing unit Q3 comprises a double construction including an outer case H1 made of e.g. metal and a heating case H2 disposed within the outer case H1 with air heat-insulating layer formed therebetween. On the upstream of the heating case H2 in the transporting direction of the recording medium M, there is provided a pinch roller type first assist transporting mechanism 175 and on the downstream of the heating case H2, there is provided a pinch roller type second assist transporting mechanism 176 for transporting the recording medium M. Further, a cutter 177 for cutting the recording medium M is provided on the downstream of the second assist transporting mechanism.

The heating case H2 includes a bottom wall member Wb, a ceiling member Wt, side wall members Ws1, Ws2 disposed on the right and left, and side wall members Wf, Wr disposed transportation-wise upstream and downstream of the recording medium M respectively. These side wall members Wf, Wr define slits Yf, Yr for allowing passage of the recording medium.

Inside the heating case H2, the heating space R is formed. That is to say, this heating space R forms heating spaces R1, R2 above and blow the transport passage for the recording medium M. On the bottom face of the lower heating space R1, there is provided an electric planar heater 180, and the upper heating space R2 includes a rod-like temperature sensor 181 horizontally disposed for detecting the temperature of the air present inside the heating case H2. There is also provided a fan 182 for circulating the air within the heating space R. The planar heater 180 is divided, into three section of a first heating section 180*a*, a second heating section 180*b* and a third heating section 180*c*, from its side adjacent a home position HP along the width direction of the recording medium M. And, these heating sections can be independently controlled for their temperature and ON/OFF.

The heat fixing section Q3 includes a heating area adjusting mechanism for adjusting the width size of the heating area R. This heating area adjusting mechanism includes a shutter member 183 in the form of a vertical partitioning plate, two threaded shafts 184, 184 disposed between the side wall members Ws1, Ws2 and threadably engaged with the shutter member 183, and a drive motor 186 for providing drive to bevel gears 185 mounted on the ends of these two threaded shafts 184, 184.

The heating space R includes a plurality of support guide members 190 for coming into contact with the lower face of the recording medium M for guiding the medium with the horizontal posture. These support guide members 190 are arranged in a zigzag pattern between a plurality of legs 191 supported to be movable to the inside of horizontal grooves G of the slits Yf, Yr. Each support guide member 190 is formed of a material which per se is elastically deformable or is urged at its portion adjacent the leg 191, so as to separate the left side wall member Ws1 and the shutter member 183 apart from each other along the width direction of the recording medium M. With this, as may be understood from FIG. 20A and FIG. 20B, the grill-like guide faces of the number of support guide members 190 are capable of varying their extension range in accordance with movement of the shutter member 183 by the heating area adjusting mechanism.

With the above-described construction in operation, when a recording medium having the maximum width is fed, the shutter member 183 is moved to its position corresponding to the maximum width of the heating area R and at the same time power is supplied to all of the three sections 180*a*, 180*b*, 180*c* of the planer heater 180 for heating the heating space R and the recording medium R is transported at a predetermined speed by the first assist transporting mechanism 175 and the second assist transporting mechanism 176. Also, when a recording medium M of a smaller width is fed, the shutter member 183 is moved to a position corresponding to that width of the recording medium M and power is supplied only to a limited section of the planar heater 180 so as to heat only the air inside the limited heating space R and the medium M is transported at the predetermined speed. With such control scheme, it is possible to control the apparatus without power waste by limiting the power used for heating in the case of a recording medium of a smaller width.

The invention may be embodied in any other manner as described above. Further changes or modifications will be apparent for those skilled in the art from the foregoing disclosure within the scope of the invention defined in the appended claims.

The invention claimed is:

1. A heat fixing apparatus for heating a recording medium having a substrate, a fixing layer and a surface layer so as to sublimate sublimating ink applied in advance to the surface layer for transferring the sublimated ink to the fixing layer, the apparatus comprising:

a heating case for forming a heating space;

a flat guide member for guiding the recording medium introduced into the heating case by supporting the medium from a lower face thereof;

a sheet heater acting as a first heater provided on a lower arc of the guide member for heating the guide member;

an upper-face contact roller for coming into contact with an upper face of the recording medium as being supported by the flat guide member so as to apply a transporting force to the recording medium;

a second heater provided upwardly of the guide member; and a blower fan for supplying air heated by said second heater on the upper face of the recording medium as being supported by the guide member;

wherein an outer peripheral face of said upper-face contact roller and an upper face of the guide member define therebetween a distance substantially equal to the thickness of the recording medium, and wherein said upper-face contact roller is arranged to oppose to said sheet heater through said guide member proximately above said sheet heater.

2. The apparatus according to claim 1, wherein the blower fan is adjustable in its blowing direction so as to supply the hot air from transportation-wise downstream to transportation-wise upstream of the recording medium.

3. The apparatus according to claim 1, wherein a plurality of said flat guide members are provided along a transporting direction of the recording medium, some of the guide members disposed on the transportation-wise downstream having a temperature higher than the other guide members disposed on the transportation-wise upstream.

4. The apparatus according to claim 1, further comprising a double-face contacting roller adjacent the guide member relative to the transporting direction of the recording medium, wherein said double-face contacting roller includes a pair of upper rollers and a single roller arranged in a zigzag pattern in a side view, an outer peripheral face of the upper rollers and an outer peripheral face of the lower roller defining therebetween a distance substantially equal to a thickness of the recording medium, the upper rollers and the lower roller together providing a transporting force to the recording medium by coming into contact with the recording medium.

5. The apparatus according to claim 1, further comprising a slow cooling section for discharging heat from the recording medium while providing the recording medium with heat of a temperature lower than the heating temperature of the heating space.

6. The apparatus according to claim 5, wherein said slow cooling section includes a guide member inclined for guiding the recording medium obliquely downward while contacting the lower face of the recording medium discharged in the horizontal direction from the heating space and an electric heater for heating the guide member, the electric heater heating the guide member at a temperature which is gradually lowered on the downstream side in the transporting direction of the recording medium.

* * * * *